US007997881B2

(12) United States Patent
Smith et al.

(10) Patent No.: US 7,997,881 B2
(45) Date of Patent: Aug. 16, 2011

(54) COMBINED PRIME VALVE AND ELECTRICAL PRESSURE CONTROL FOR PAINT SPRAY PUMPS

(75) Inventors: Jeffrey Mark Smith, New Market, MN (US); Craig Peterson, Carver, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 1064 days.

(21) Appl. No.: 11/772,693

(22) Filed: Jul. 2, 2007

(65) Prior Publication Data

US 2009/0008481 A1 Jan. 8, 2009

(51) Int. Cl.
*F04B 39/00* (2006.01)
*F04B 53/00* (2006.01)

(52) U.S. Cl. ..... 417/435; 417/44.1; 417/441

(58) Field of Classification Search ..... 239/569, 239/581.1, 581.2, 583, 329, 332; 251/251; 137/560; 417/435, 441, 44.1
See application file for complete search history.

(56) References Cited

U.S. PATENT DOCUMENTS 3,614,351 A * 10/1971 Wojcik ..... 200/61.86
4,355,761 A 10/1982 Bjorn et al.
4,390,324 A 6/1983 Karliner
4,416,488 A 11/1983 Wall
4,768,929 A 9/1988 Geberth, Jr.
4,768,932 A 9/1988 Geberth, Jr.
4,834,287 A 5/1989 Walsh et al.
4,928,722 A 5/1990 Walsh et al.
5,059,099 A 10/1991 Cyphers
5,655,885 A 8/1997 Chung
5,725,364 A 3/1998 Mirazita
6,328,223 B1 12/2001 Holt et al.
6,419,456 B1 7/2002 Cooper et al.
6,599,107 B2 7/2003 Cooper et al.

OTHER PUBLICATIONS

International Search Report issued in GB Application No. 0811806:9, date of search Oct. 23, 2008, 1 page.

* cited by examiner

*Primary Examiner* — Charles G Freay
*Assistant Examiner* — Christopher Bobish
(74) *Attorney, Agent, or Firm* — Faegre & Benson LLP

(57) ABSTRACT

A combined prime valve and electrical pressure control apparatus including a prime valve actuator, an electrical pressure control actuator, and a control housing containing the actuators, with each coupled to a single shaft having a cam assembly for selectively actuating the control apparatus to one of a prime mode and a spray mode and the electrical pressure control is operable within a range of pressure settings by movement of the shaft while the control apparatus remains in the spray mode. The actuators are oriented diametrically opposite and offset along an axis of the single shaft with respect to each other, and contact the cam assembly and respectively contact a lever for a prime valve and a pressure switch carrier. A setscrew in the carrier provides adjustment of the pressure at which the switch is actuated.

14 Claims, 31 Drawing Sheets

COMBINED PRIME VALVE AND ELECTRICAL PRESSURE CONTROL FOR PAINT SPRAY PUMPS

BACKGROUND OF THE INVENTION

The present invention relates to the field of paint spray pumps, particularly those which have a need for both a priming mode or function and an adjustable pressure mode or function while spraying after priming.

Prior art pumps typically had a fixed pressure setting and switched from a priming mode to a spraying mode at the fixed pressure setting. Other prior art pumps had a pressure adjustment mechanism separate from the prime/spray control. The present invention provides an improvement over such arrangements by providing an integrated apparatus that provides both prime/spray mode control and adjustable pressure setting operation for an electrical pressure control in the spray mode.

BRIEF SUMMARY OF THE INVENTION

The present invention may be seen to be a combined prime valve and electrical pressure control apparatus for paint spray pumps including an inlet port and an outlet port and a return port for the paint spray pump, a prime valve, and a pressure control, with the prime valve and pressure control each contained within a single control housing and each coupled to a single shaft for selectively actuating the prime valve to one of a prime mode and a spray mode, wherein the valve in the prime mode fluidly couples the inlet port to the return port and wherein the valve in the spray mode couples the inlet port to the outlet port and wherein the pressure control is operable within a pressure setting range to control the operation and output pressure delivered by the pump using an electrical control adjustable by movement of the shaft while the valve remains in the spray mode.

DETAILED DESCRIPTION

Figure 1:
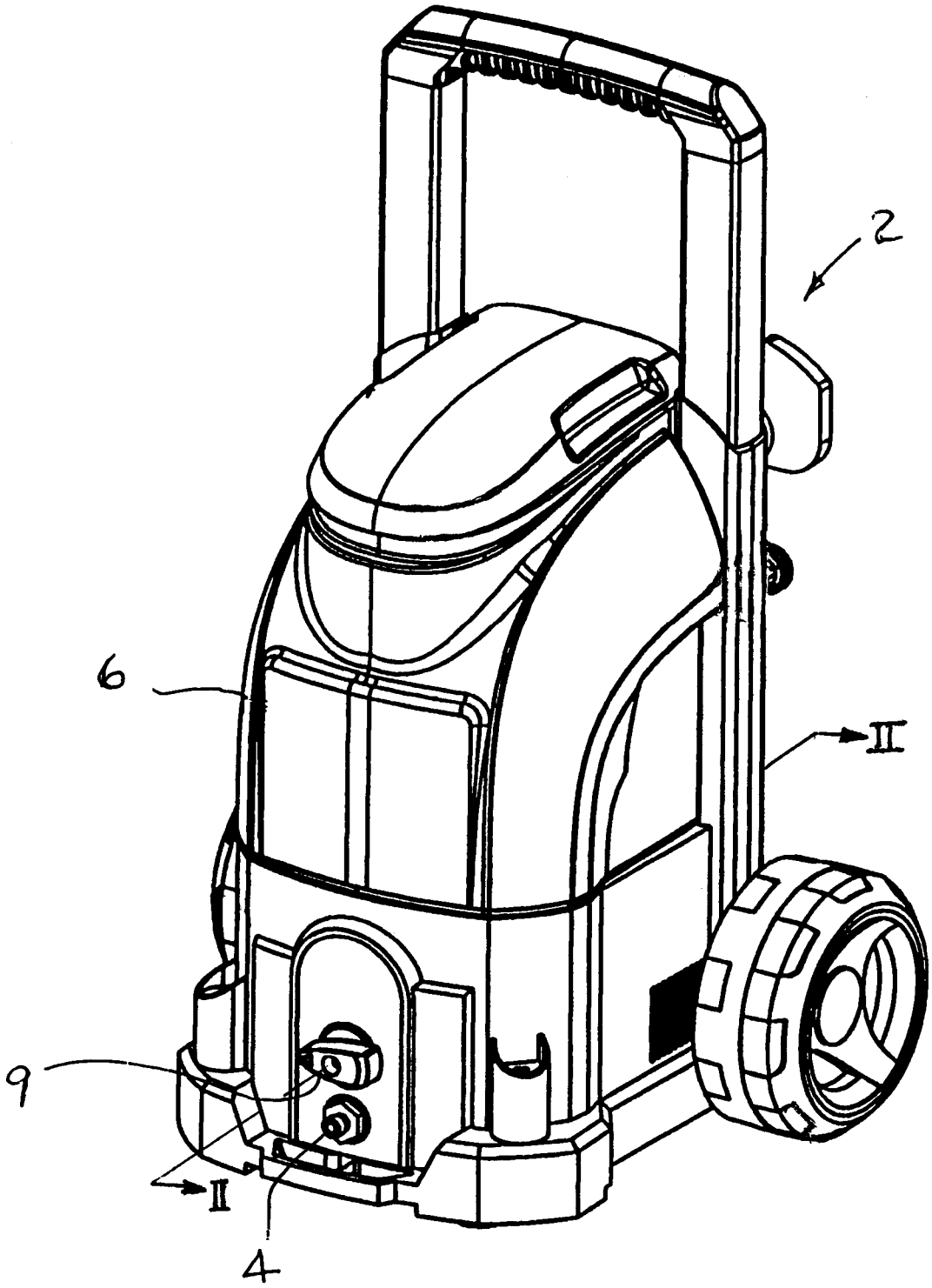
FIG. 1 is a perspective view of a paint sprayer pump assembly useful in the practice of the present invention.
Figure 2:
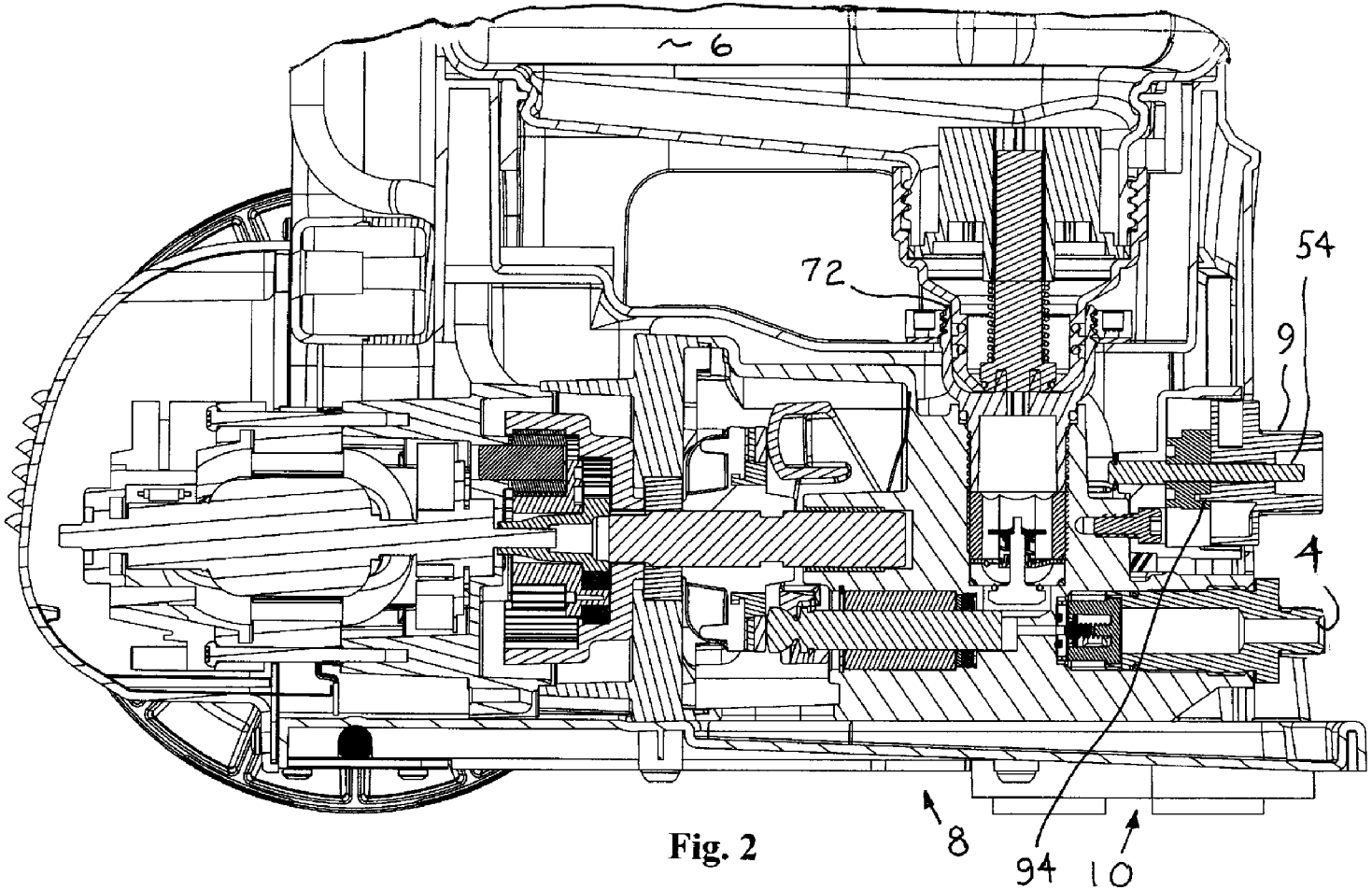
FIG. 2 is an enlarged fragmentary side section view of the paint sprayer pump assembly taken along line II-II of FIG. 1.

Referring now to the Figures, and most particularly to FIGS. 1 and 2, a paint spray pump assembly 2 useful in the practice of the present invention may be seen. It is to be understood that assembly 2 is designed and intended to be used to supply paint or similar coating material under pressure to a hand-held paint spray gun (not shown) via a hose (not shown) connected to a paint pump outlet 4. A paint hopper 6 provides paint to the pump 8. A knob 9 is provided to operate the combined prime valve and pressure control 10 of the present invention.

Figure 3:
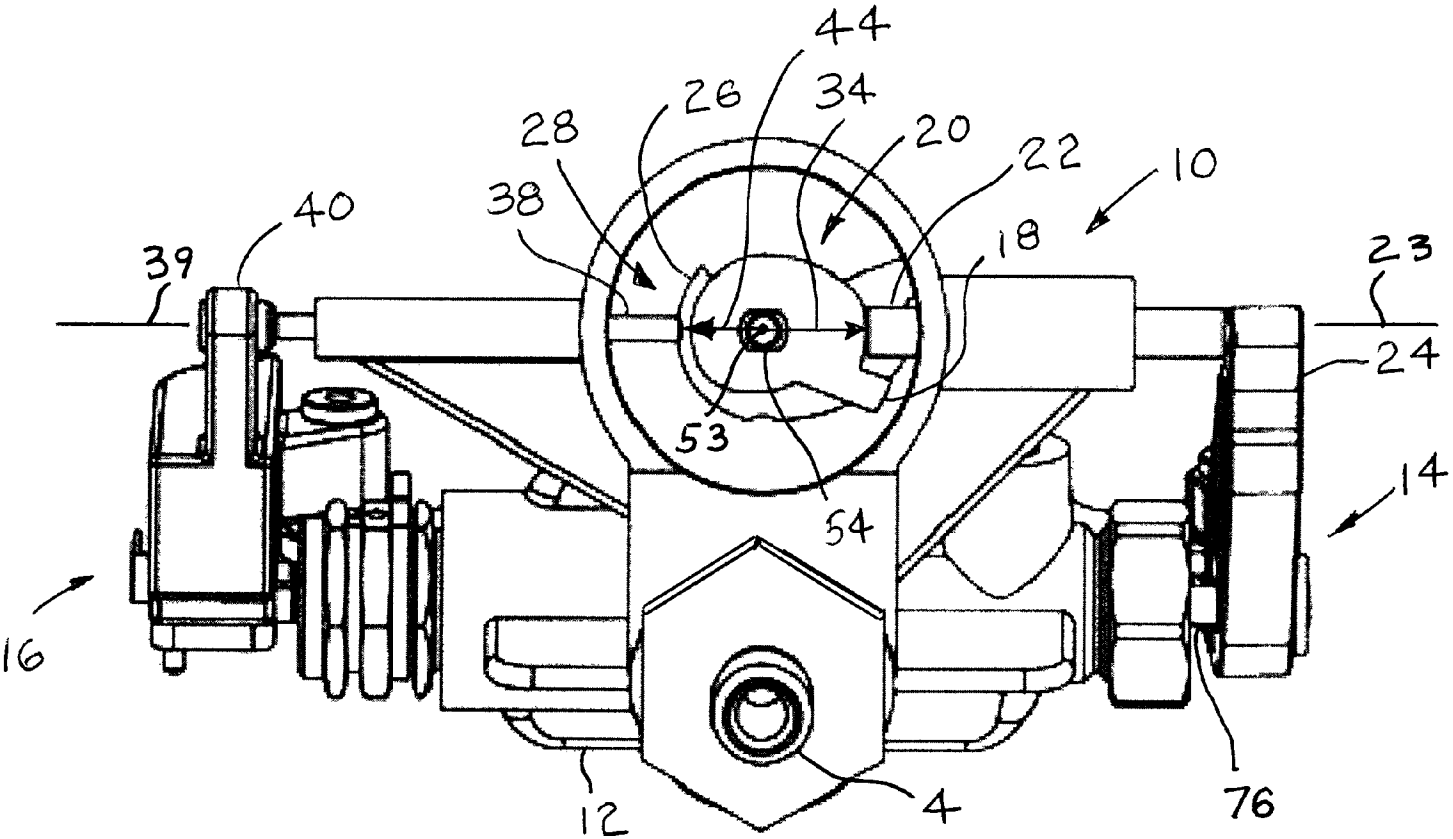
FIG. 3 is a front elevation view of a combined prime valve and electrical pressure control apparatus of the present invention shown in a priming mode.

Referring now also to FIG. 3, a front elevation view of the prime valve and pressure control apparatus 10 of the present invention may be seen. The apparatus has a single control housing 12 for both the prime valve 14 and the pressure control 16. A first cam 18 is shown in a first position 20 corresponding to a priming mode. In this position, cam 18 pushes a single prime control pin 22 that urges a lever 24 to pull a poppet (not shown) off a seat (not shown) to provide a priming mode for the paint pump 8 to which apparatus 10 is fluidly connected. In position 20, a second cam 26 is in a first position 28, corresponding to a low pressure setting. The single prime control pin or prime valve actuator 22 is oriented with and free to move along a prime valve actuator axis 23. Cam 18 is movable about an axis 53 of a single shaft 54 on which cam 18 is mounted.

Figure 4:
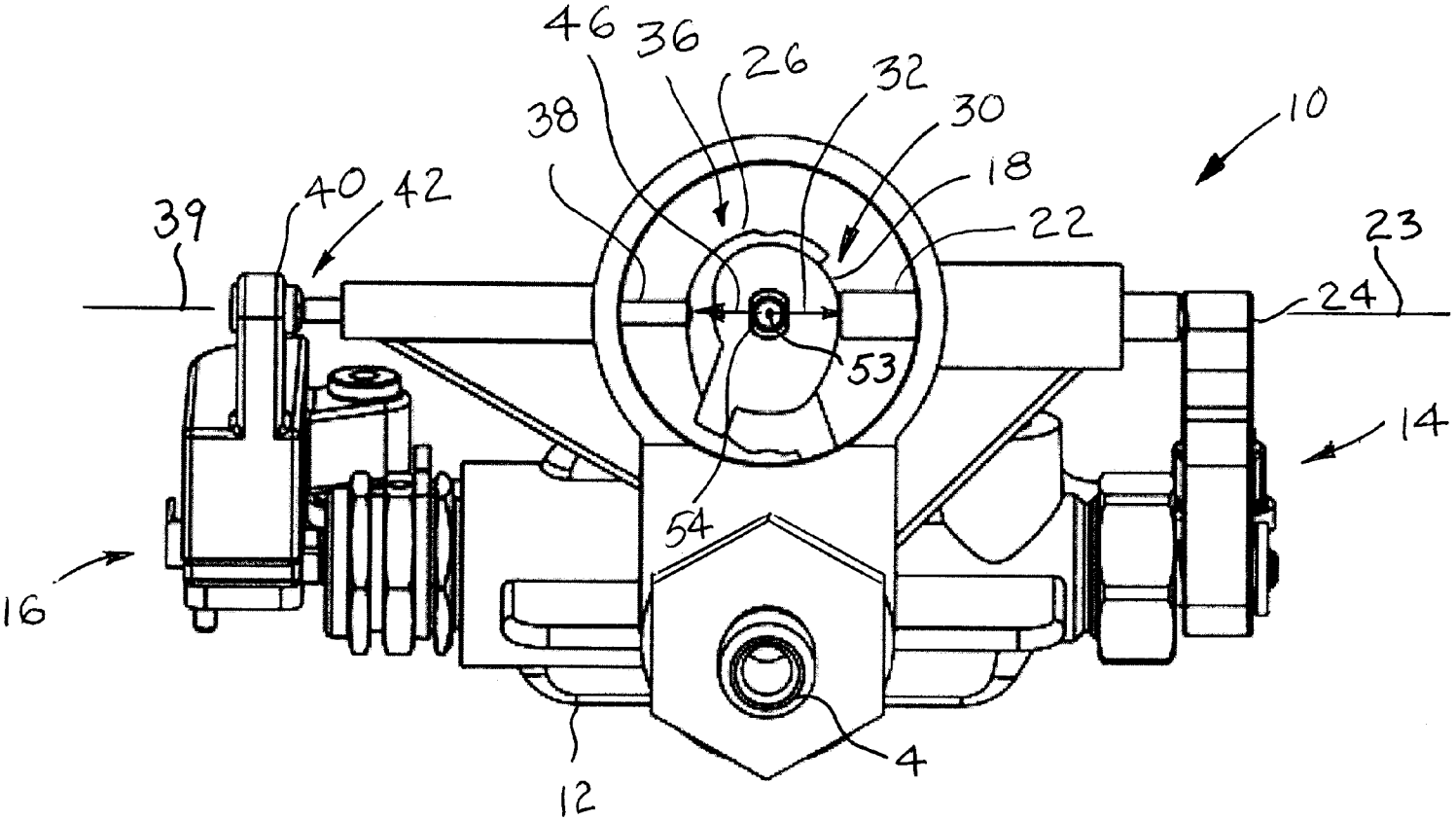
FIG. 4 is a view similar to that of FIG. 3, except shown in a spray mode with a low pressure setting.

Referring now to FIG. 4, first cam 18 is in a second position 30, corresponding to a spraying mode in which the priming mode is deactivated. It may be noted that a radius 32 of cam 18 at the pin 22 in the second position 30 is less than a radius 34 of cam 18 at pin 22 in the first position 20 (FIG. 3). This allows the poppet of the prime/spray valve to return to contact with its mating seat to shift from a priming mode to a spraying mode.

Second cam 26 is shown in a second position 36 in FIG. 4 in which a pressure control pin 38 urges a switch carrier 40 to move to a low pressure position 42. It is to be understood that the pressure control pin or electrical pressure control actuator 38 is oriented with and movable along an electrical pressure control actuator axis 39. It is also to be understood that the second position 36 is preferably only slightly elevated above the pressure level of the first position 28 of cam 26, indicated by the slightly increased radius 44 of cam 26 at pin 38 in this position, compared to the radius 46 of cam 26 at pin 38 when cam 26 is in the first position 28. Each of the axes 23 and 39 are oriented generally diametrically opposite one another, and perpendicular to axis 53. As will be seen infra, the axes 23 and 39 are offset along axis 53 from each other, to align with cams 18 and 26, respectively.

Figure 5:
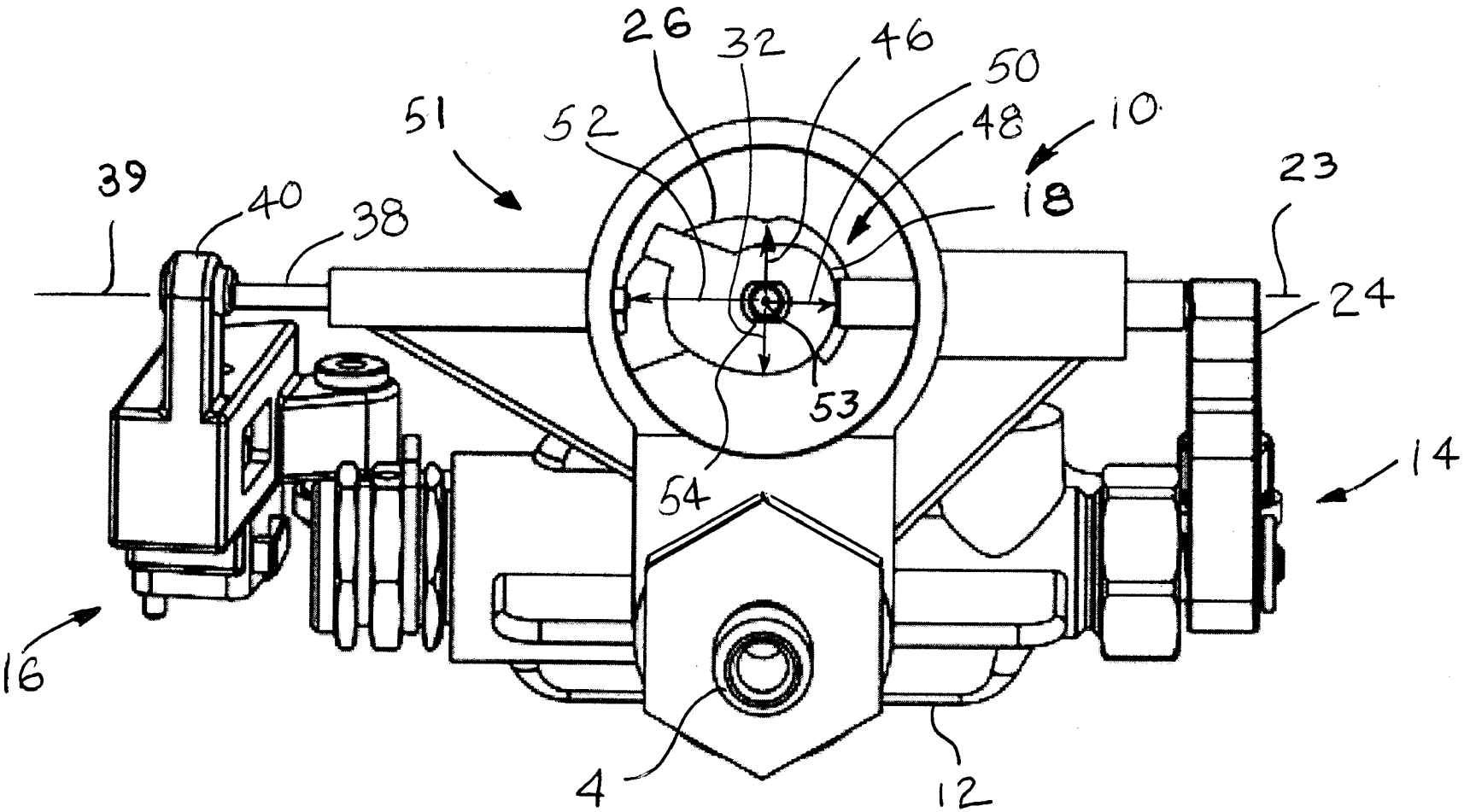
FIG. 5 is a view similar to that of FIG. 3 in the spray mode, except shown at a high pressure setting.

Referring now to FIG. 5, first cam 18 moves to a third position 48 in which cam 18 has a radius 50 substantially equal to radius 32, keeping the prime/spray valve 14 in the spray mode. In FIG. 5, cam 26 has an increased radius 52 aligned with pin 38 as compared to the operating radius 46 of FIG. 4 for the low pressure spraying mode. The increased radius 52 sets the switch carrier 40 to a third or high pressure position 51 (for both the pressure control 16 and the second cam 26).

It is to be understood that the knob 9 is preferably received over a shaft 54 to operate apparatus or assembly 10. Shaft 54 is rotatable to a selected one of the first position 20, 28, the second position 30, 36 and the third position 48, 51, as desired, by an operator, to achieve a selected one of the priming, low pressure spraying and high pressure spraying modes.

Figure 8:
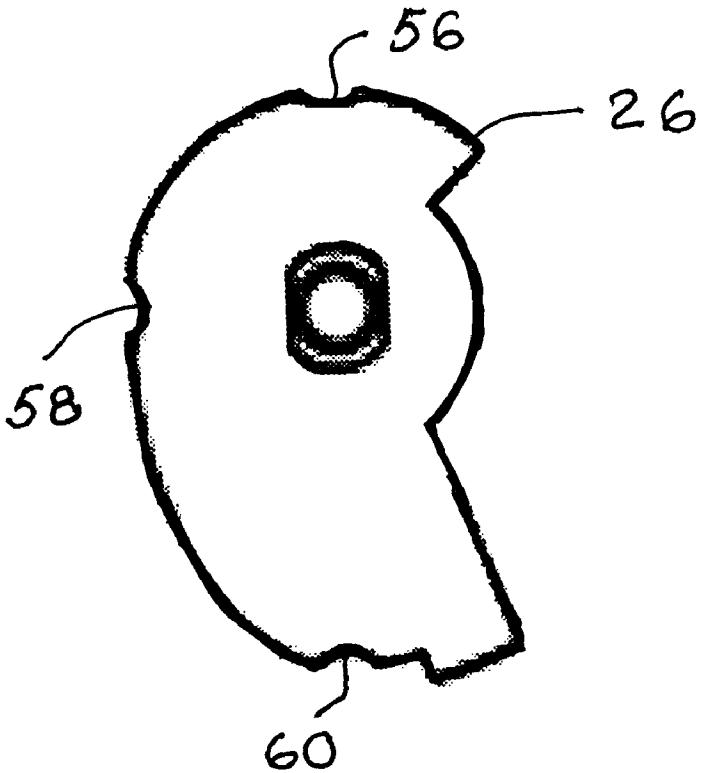
FIG. 8 is a plan view of a pressure setting cam useful in the practice of the present invention.
Figure 9:
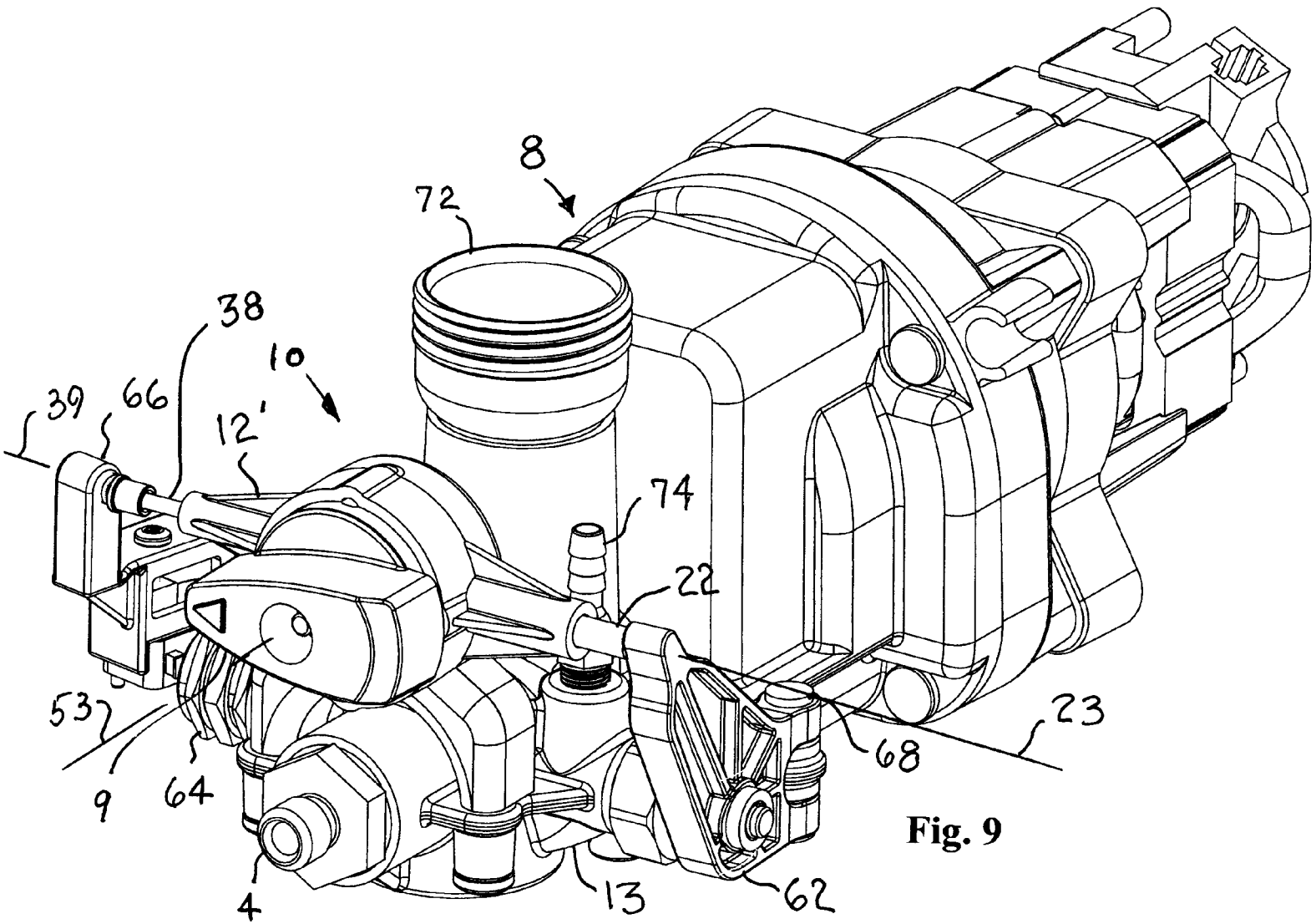
FIG. 9 is a perspective view of an electric motor and pump assembly useful in the practice of the present invention.

Referring now to FIG. 8, an outline view of the second cam 26 may be seen. In this embodiment, cam 26 may have indentations or detents 56, 58 and 60 aligned respectively with the first position 28, the second position 36 and the third position 51, to assist the operator in positioning knob 9 to the desired mode of operation, and to retain the apparatus in the selected desired mode at one of the first, second and third positions 28, 36, and 51, corresponding to the priming mode, low pressure spraying mode, and high pressure spraying mode.

Referring now to FIGS. 9-16, various views of an alternative embodiment of the present invention may be seen. In this embodiment, slight alterations may be seen in the cam assembly containing cams 18' and 26.' A pump inlet 72 receives paint from the paint hopper 6. The pump 8 delivers paint to the outlet 4 during spraying. When the apparatus 10 is in the priming mode, a valve is opened between the pump inlet 72 and the return line 74, with the valve actuator 76 moving to the left, as shown in FIG. 3.

Figure 10:
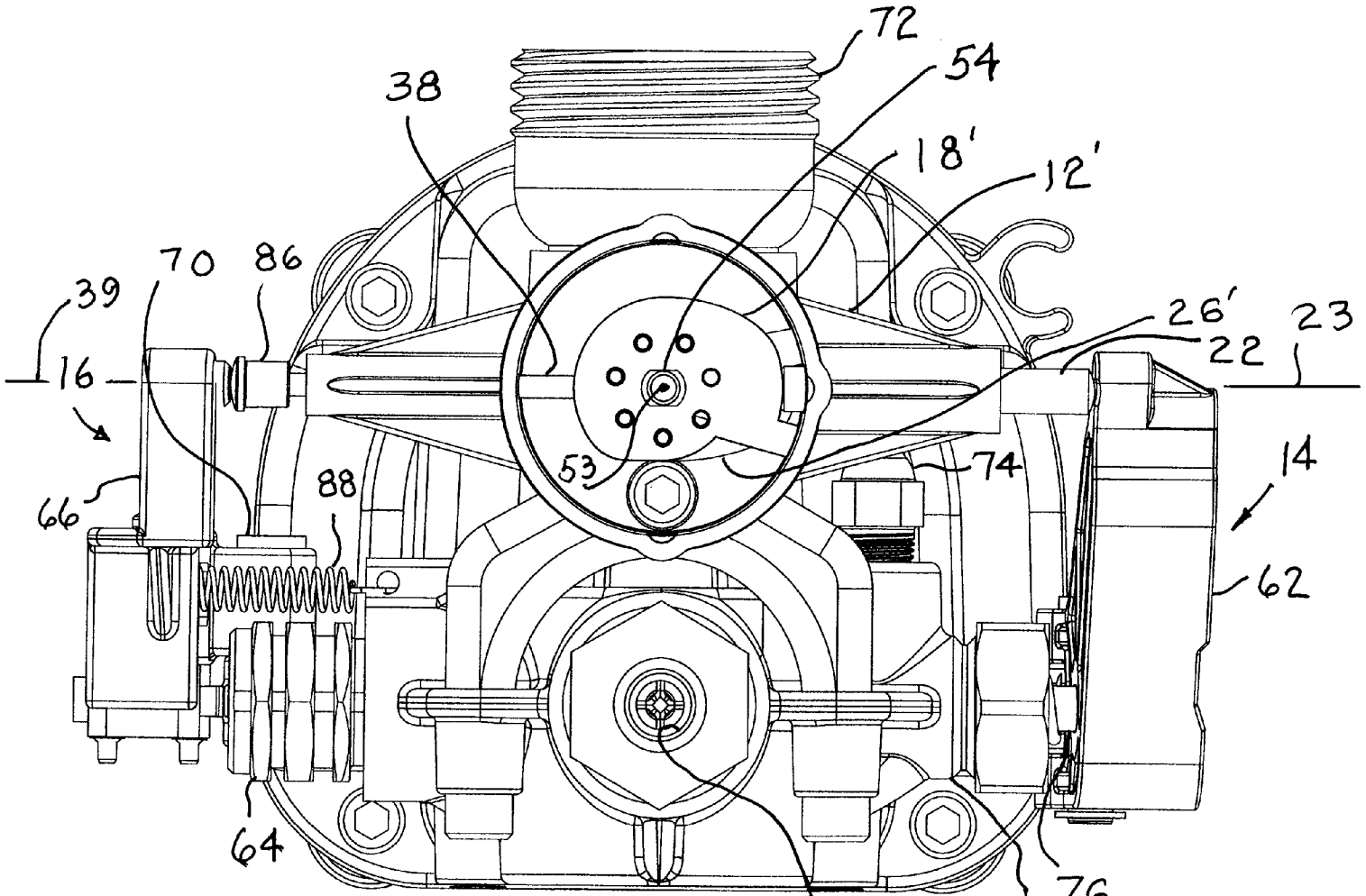
FIG. 10 is a front elevation view of the motor and pump assembly of FIG. 9.

In FIG. 10 the prime valve and pressure control apparatus 10 is shown in the first position 20 (the prime mode) corresponding to that shown in FIG. 3.

Figure 11:
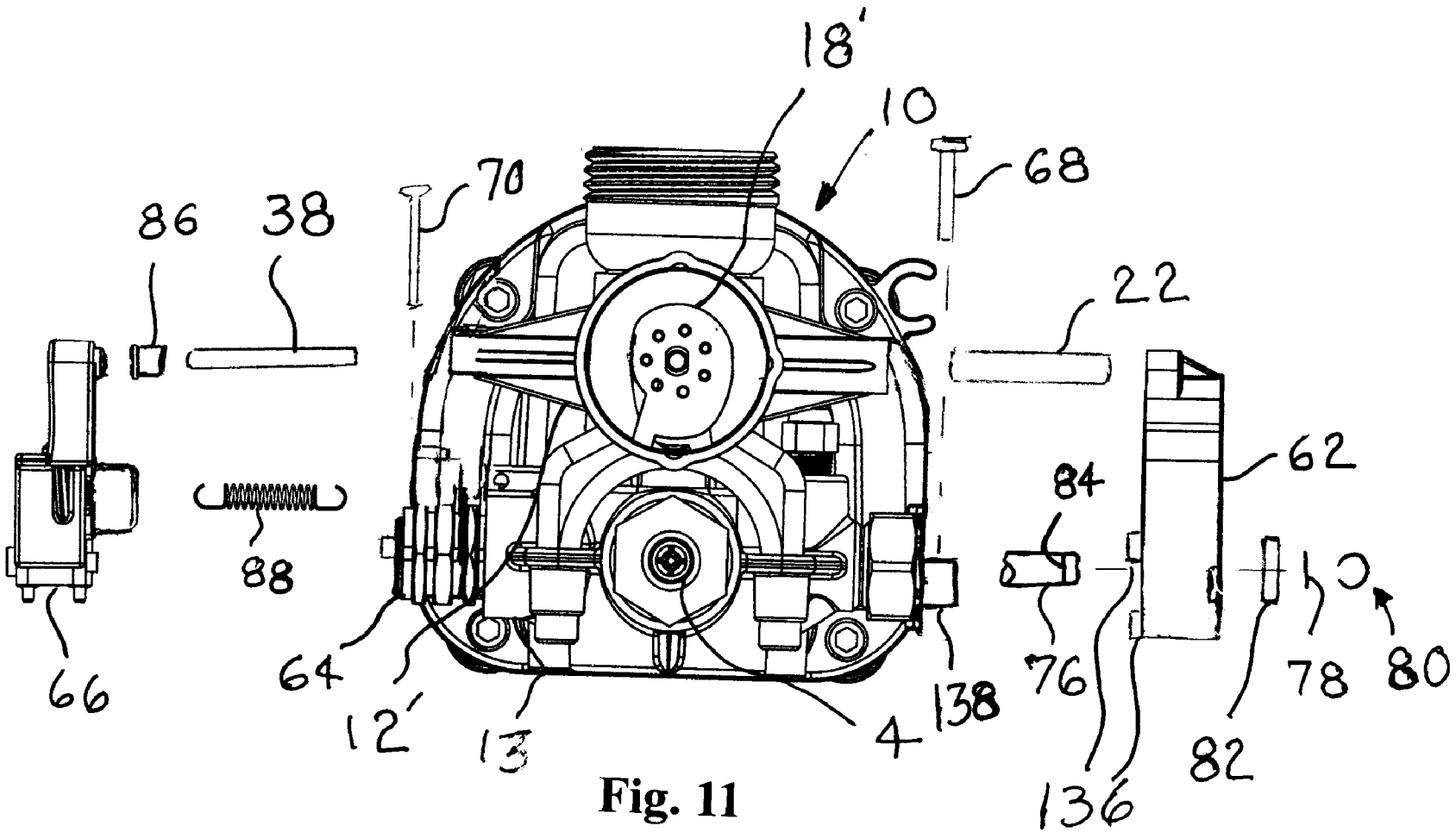
FIG. 11 is an exploded view of parts from FIG. 10.
Figure 12:
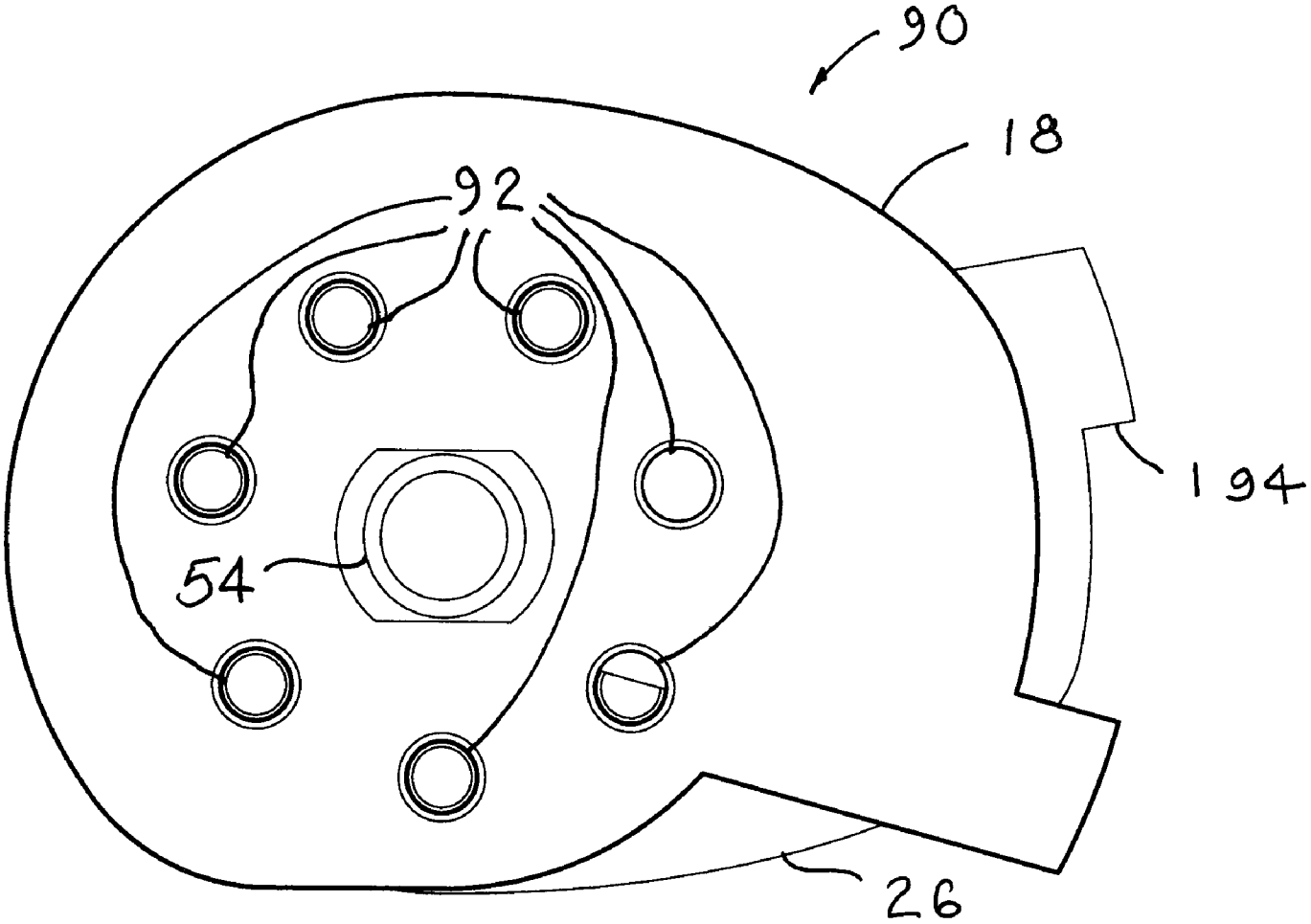
FIG. 12 is a front plan view similar to that of FIG. 8 of the cam assembly of FIGS. 10 and 11.
Figure 13:
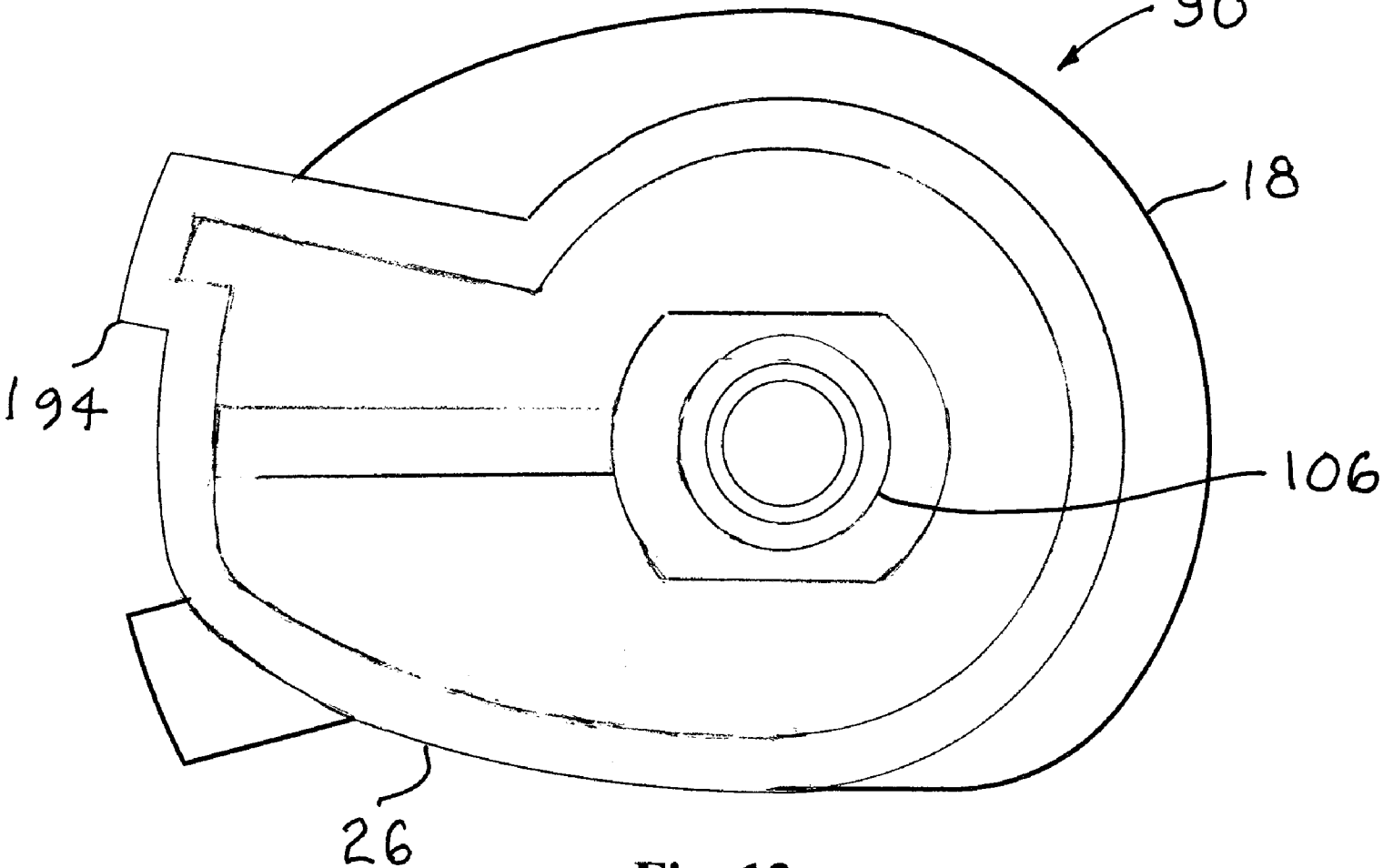
FIG. 13 is a rear plan view of the cam assembly of FIG. 12.
Figure 14:
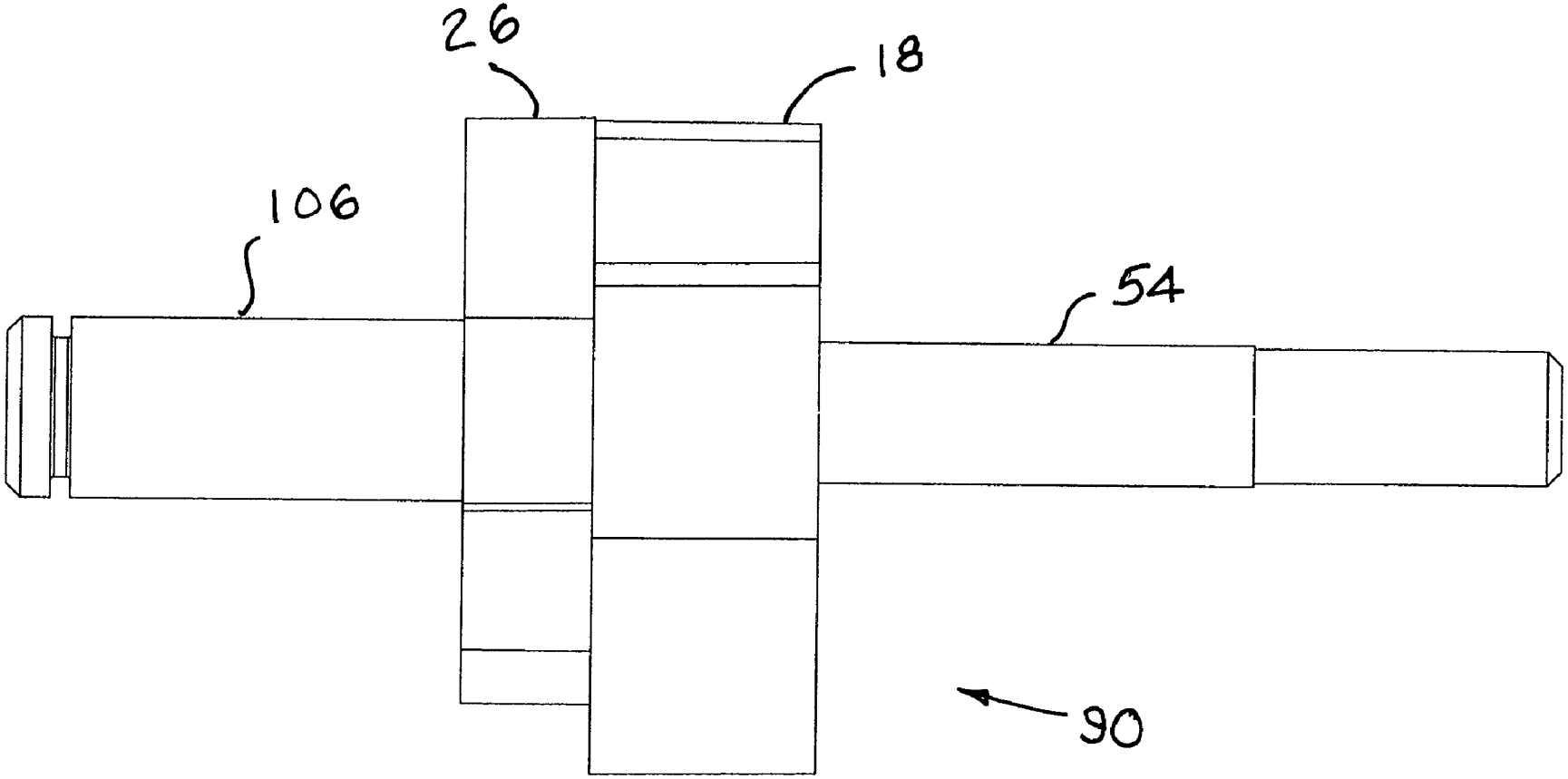
FIG. 14 is a side elevation view of the cam assembly of FIG. 12.
Figure 15:
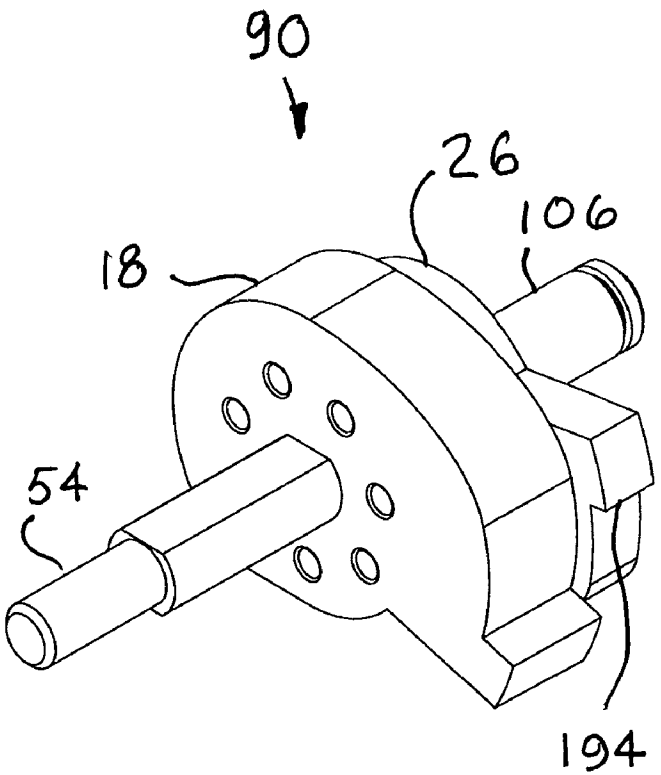
FIG. 15 is a perspective view from the front of the cam assembly of FIG. 12.
Figure 16:
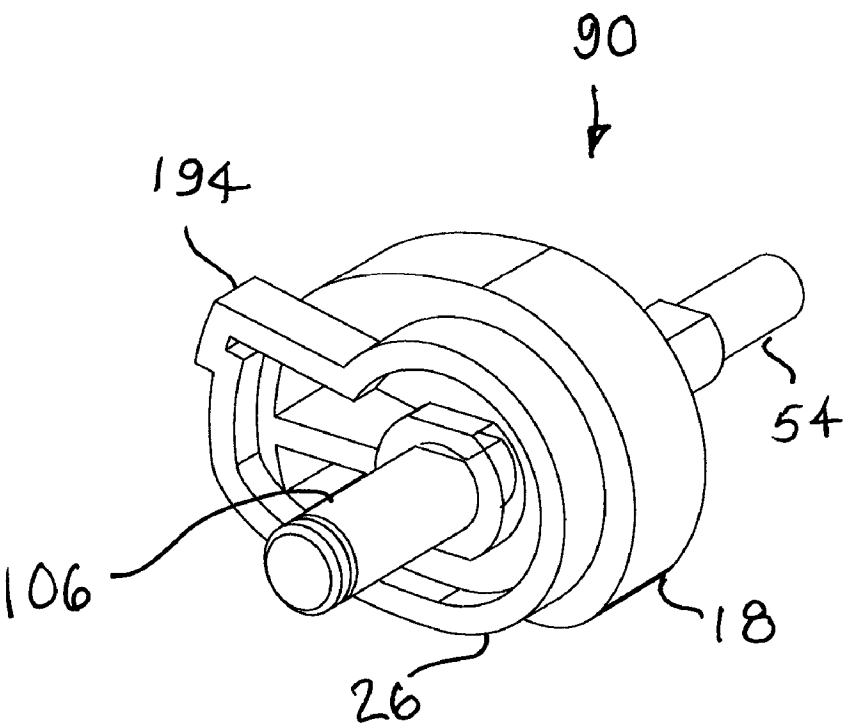
FIG. 16 is a perspective view from the rear of the cam assembly of FIG. 12.
Figure 18:
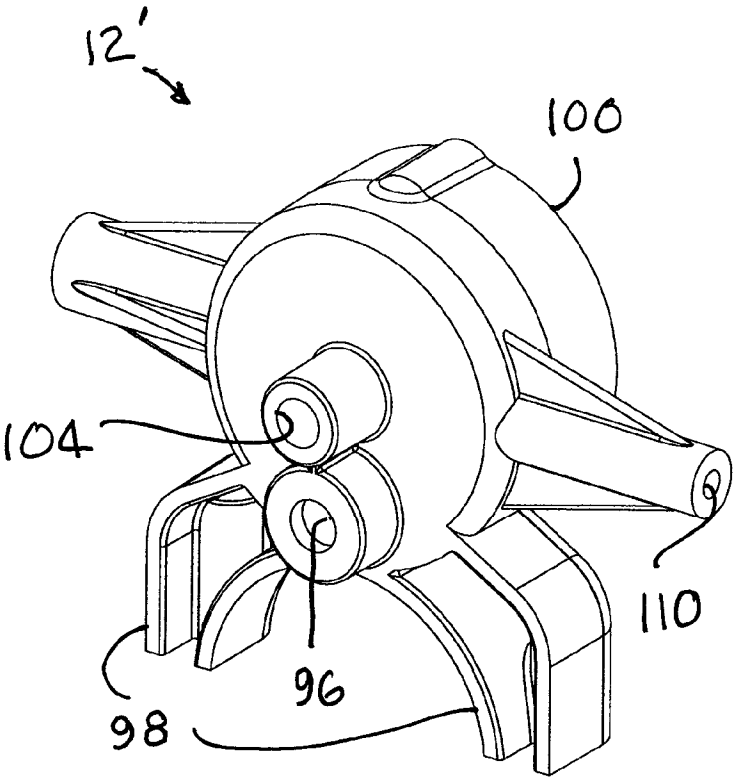
FIG. 18 is a perspective view from the rear of the control housing of FIG. 17.
Figure 17:
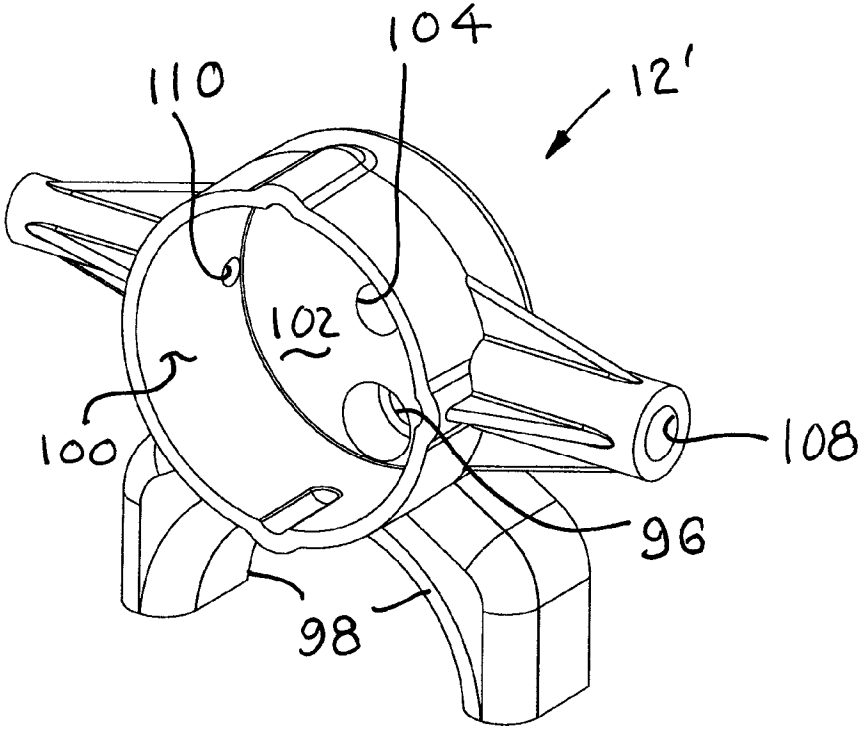
FIG. 17 is a perspective view from the front of a control housing useful in the practice of the present invention.
Figure 19:
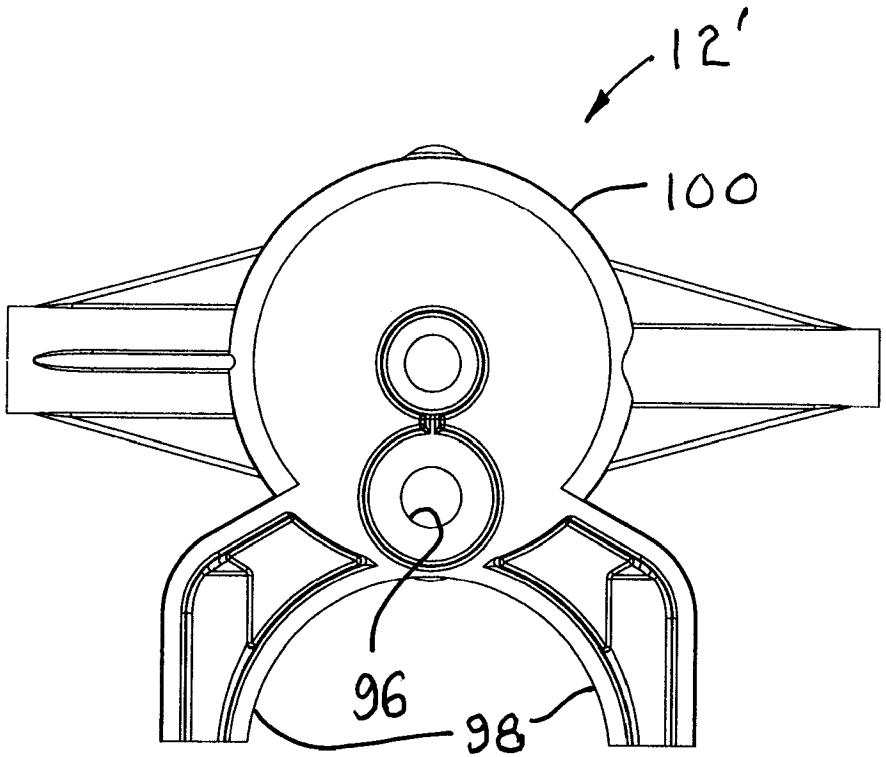
FIG. 19 is a rear elevation view of the control housing of FIG. 17.
Figure 20:
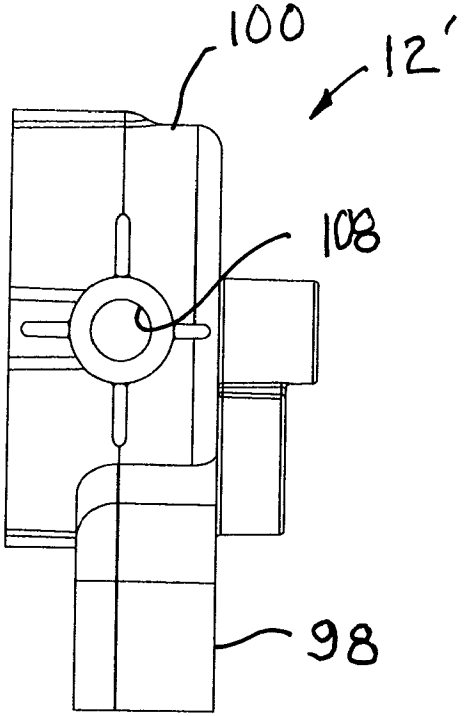
FIG. 20 is a side elevation view of the control housing of FIG. 17.

FIG. 11 shows an exploded view of the apparatus 10, with a lever 62 on one side of the control housing 12' and a pressure transducer assembly 64 and a pressure switch assembly 66 on the other side of the housing 12.' Each of the lever 62 and the pressure switch assembly 66 are retained to a base housing 13 (to which the control housing 12' is attached) by respective pivot pins 68, 70, when parts are assembled. In FIG. 11, a "C" ring 78 is shown in the exploded view and also shown rotated 90 degrees in view 80 to illustrate the topology of ring 78. Ring 78 is used to retain a washer 82 on the valve actuator shaft 76 when received in a groove 84 sized to receive ring 78, in a manner to be described infra.

Pressure control pin 38 may have a hat or cap 86, which may be formed of nylon 6/6, to provide a low friction sliding contact with the pressure switch assembly 66. Assembly 66 is held against the pressure transducer assembly 64 by a spring 88.

Referring now to FIGS. 12-16, various views of a cam assembly 90 useful in the practice of the present invention may be seen. Cam assembly 90 includes first cam 18 and second cam 26 mounted for rotation by shaft 54. A plurality of apertures 92 may be provided in cam assembly 90 for engagement with a projection 94 on knob 9 (as may be seen in FIG. 2). Reception of projection 94 in a particular one of apertures 92 provides positive, repeatable engagement between knob 9 and cam assembly 90. Cam assembly 90 may be formed by insert molding cams 18 and 26 to shaft 54.

Referring now to FIGS. 17-24, various views of control housing 12' may be seen. It is to be understood that this embodiment differs from that shown in FIGS. 3-5 in that the control housing 12 includes fluid ports, while control housing 12' is a separate housing for the cam assembly 90 and does not itself include fluid ports, but rather is connected to a pump housing having the fluid ports and certain operating components contained therein. More particularly, control housing 12 includes the outlet port 4 and the prime/spray valve (connected to valve actuator 76) and pressure transducer assembly 64. The control housing 12' (together with base housing 13) may be secured to or form part of a pump housing by a conventional threaded fastener secured through aperture 96. Control housing 12' straddles the outlet port 4 with a pair of legs 98. A cam chamber 100 provides a generally cylindrical recess 102 for the cam assembly 90. A centrally located bore 104 provides a bearing surface for a rear extension 106 of shaft 54. A first radially extending bore 108 supports the prime control pin 22 and a second radially extending bore 110 supports the pressure control pin 38. Bores 108 and 110 are preferably axially offset, as may be clearly seen in FIG. 24, to align pins 22 and 38 with the first and second cams 18, 26, respectively, when cam assembly 90 is received in the cam chamber 100.

Figure 21:
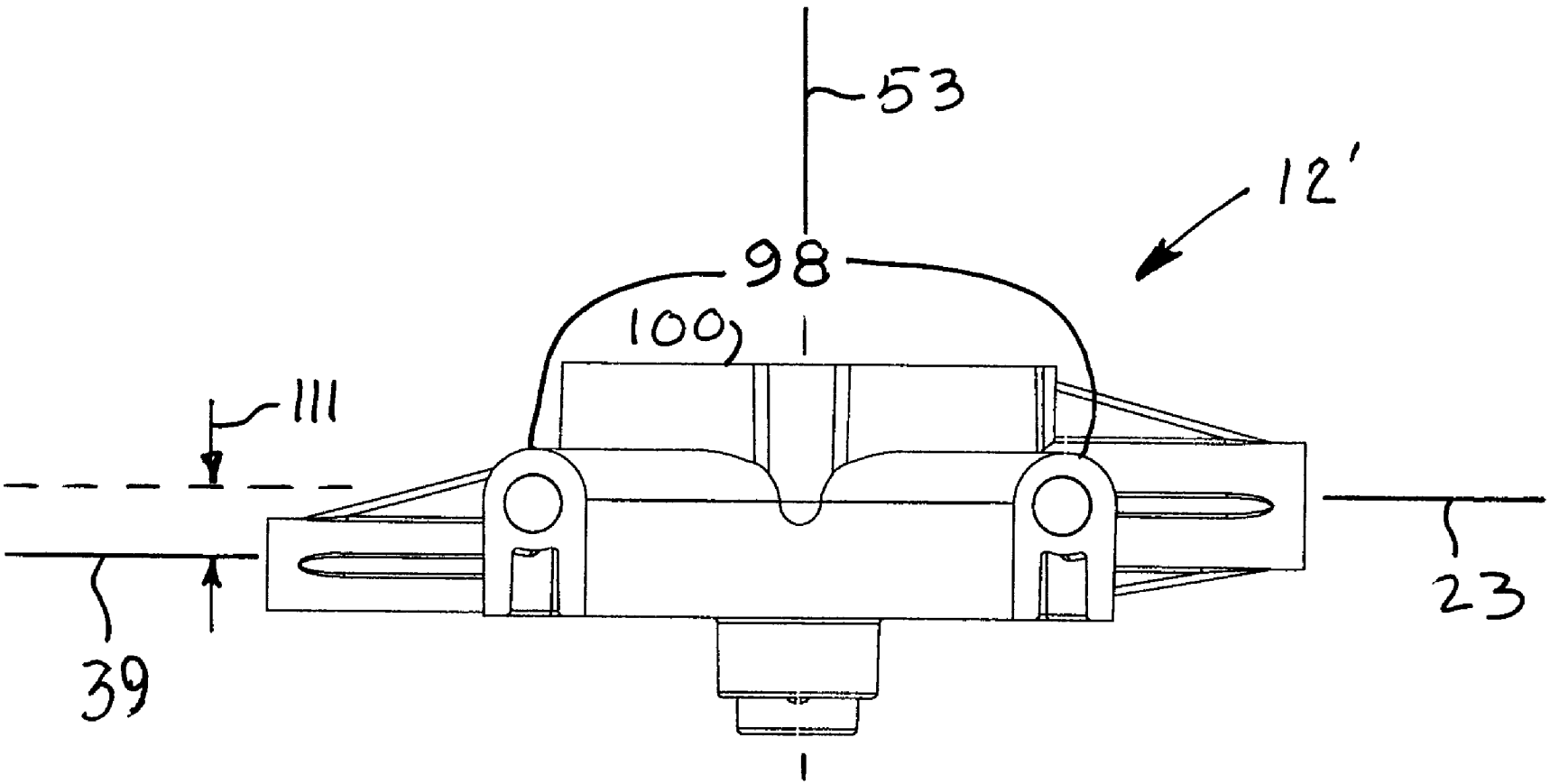
FIG. 21 is a bottom plan view of the control housing of FIG. 17.
Figure 22:
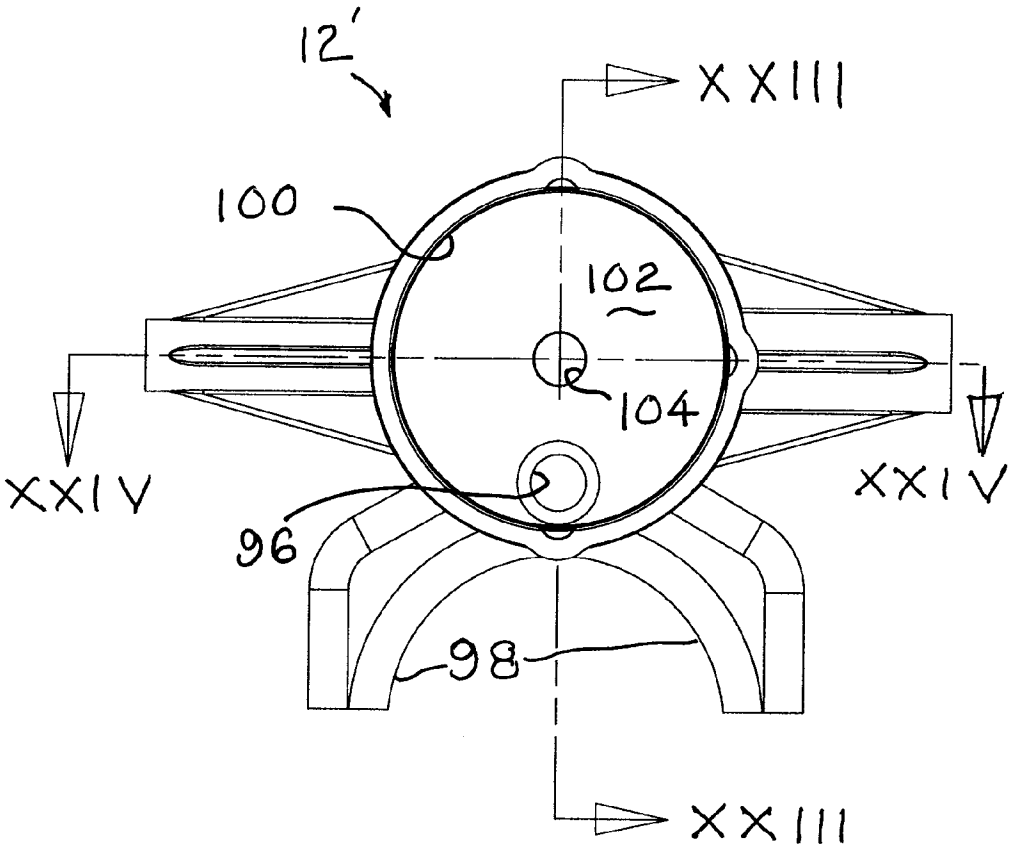
FIG. 22 is a front elevation view of the control housing of FIG. 17.
Figure 23:
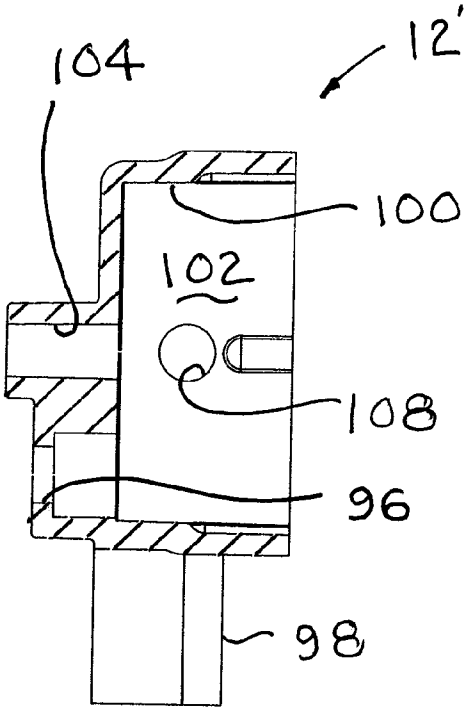
FIG. 23 is a first section view taken along line XXIII-XXIII of FIG. 22.
Figure 24:
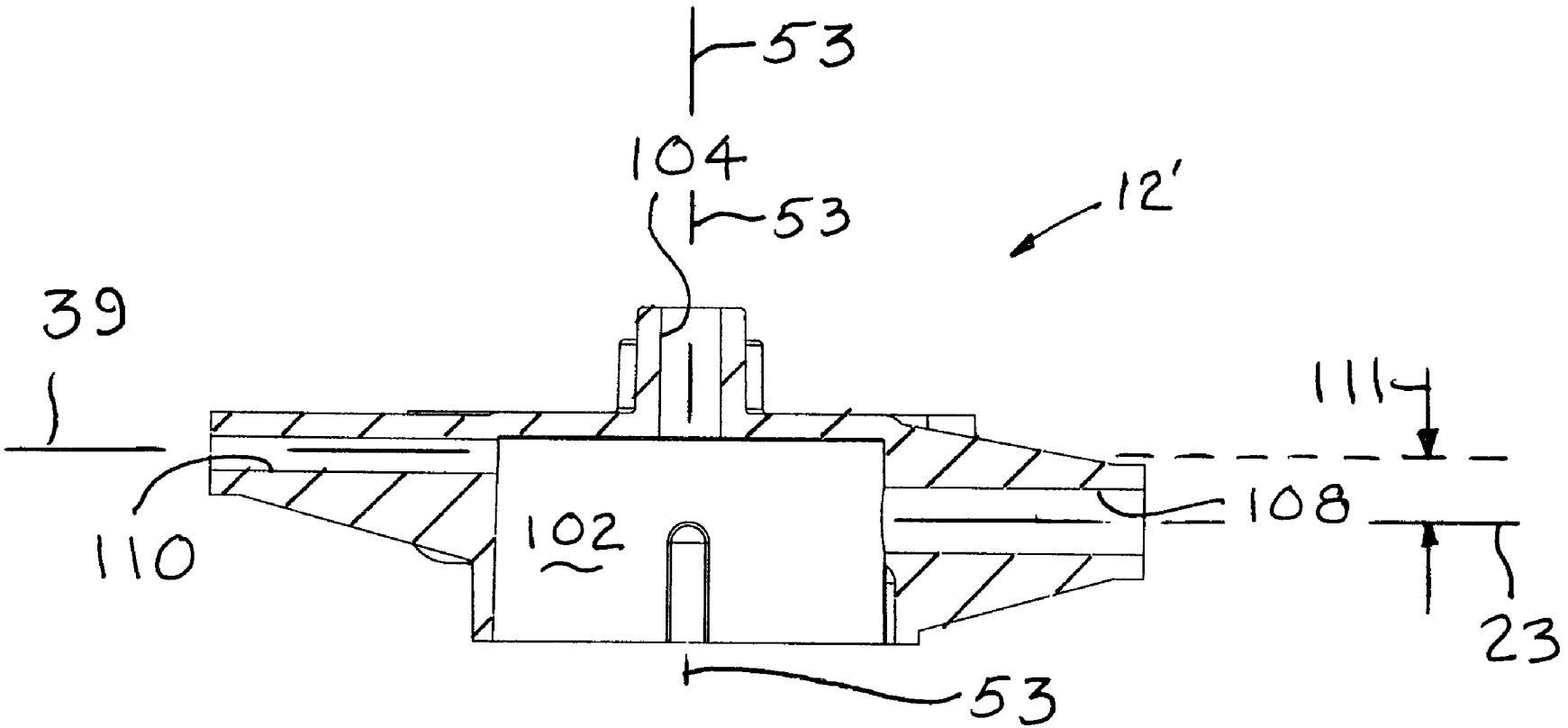
FIG. 24 is a second section view taken along line XXIV-XXIV of FIG. 22.

Referring now most particularly to FIGS. 21 and 24, there is an offset 111 between axes 23 and 39. Offset 111 is aligned with axis 53 of shaft 54 to provide alignment of pin 22 with cam 18 and alignment of pin 38 with cam 26.

Figure 26:
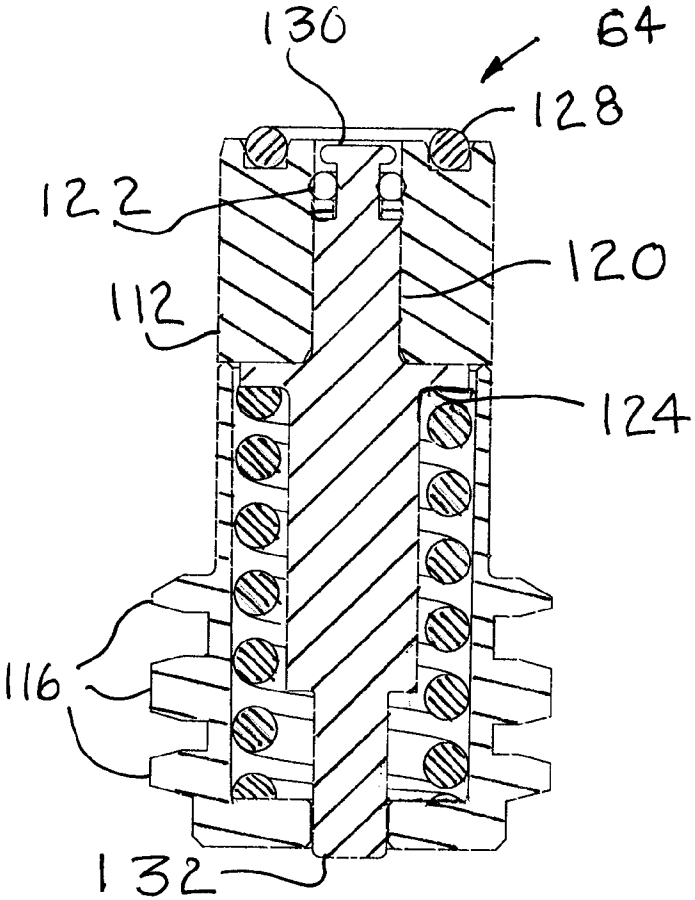
FIG. 26 is a section view taken along line XXVI-XXVI of FIG. 25.
Figure 25:
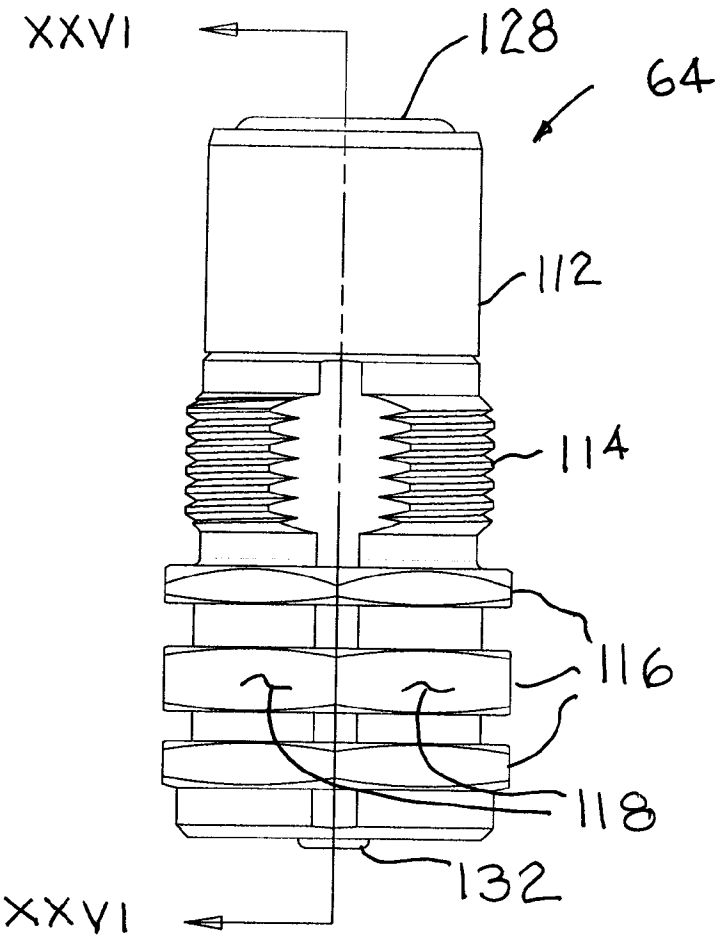
FIG. 25 is a side view of a pressure transducer assembly useful in the practice of the present invention.
Figure 27:
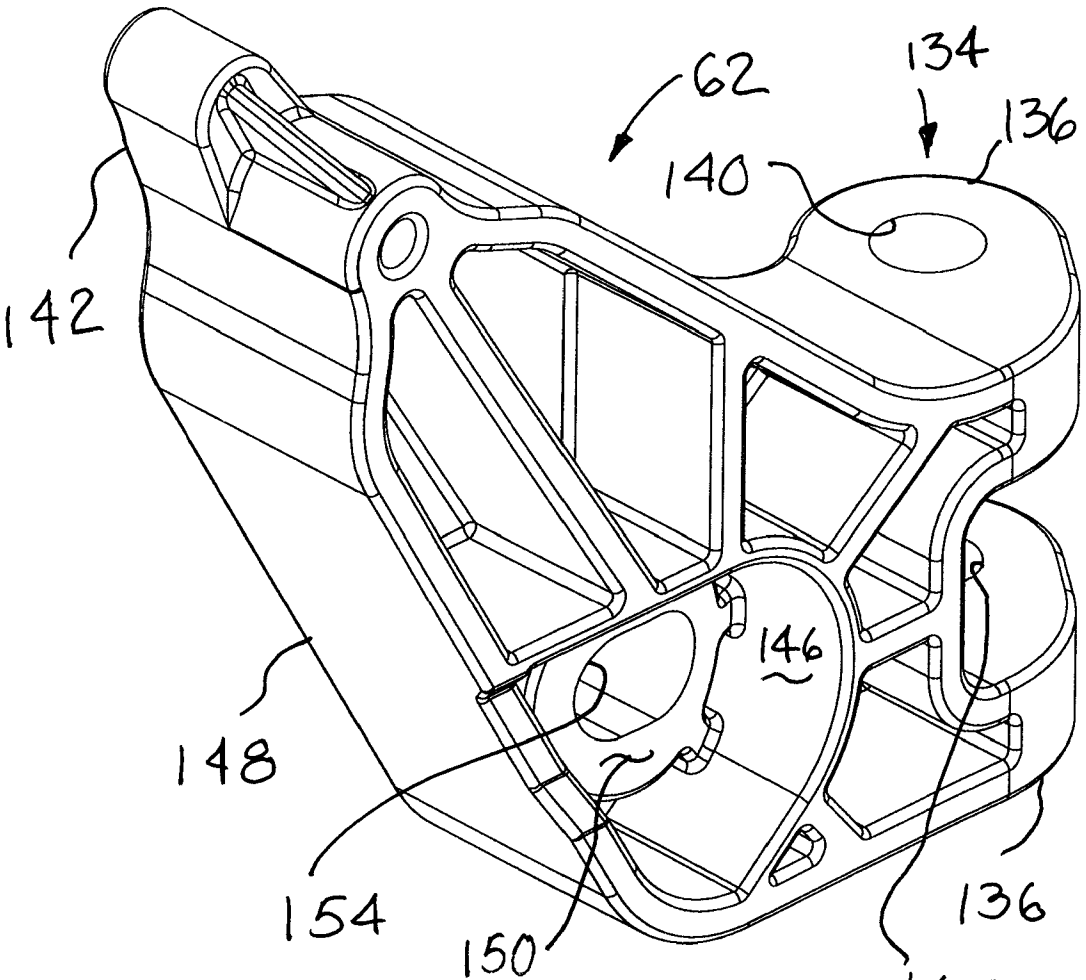
FIG. 27 is a perspective view of a lever useful in the practice of the present invention.
Figure 28:
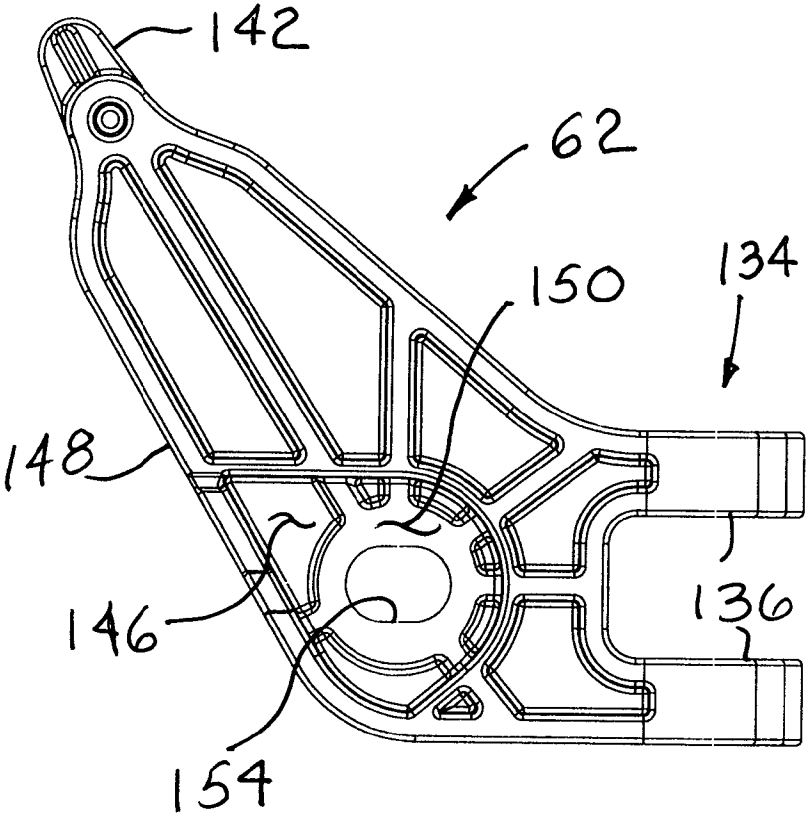
FIG. 28 is a first side elevation view of the lever of FIG. 27.
Figure 29:
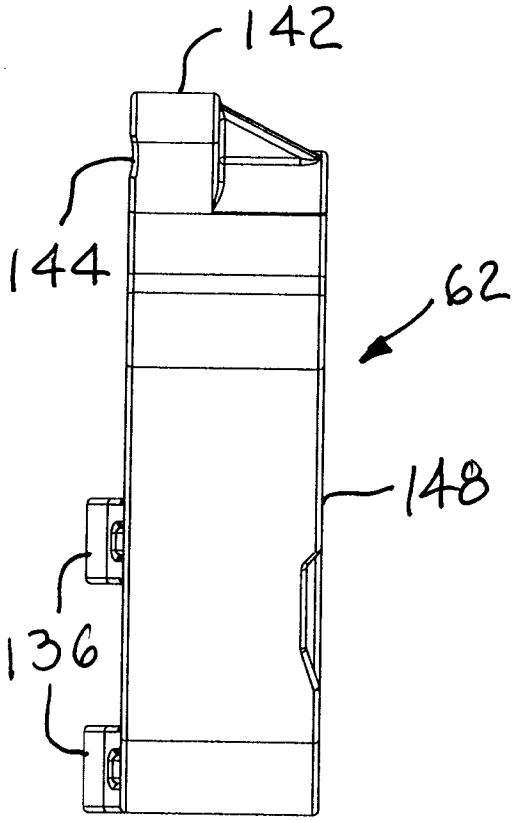
FIG. 29 is an end elevation view of the lever of FIG. 27.
Figure 30:
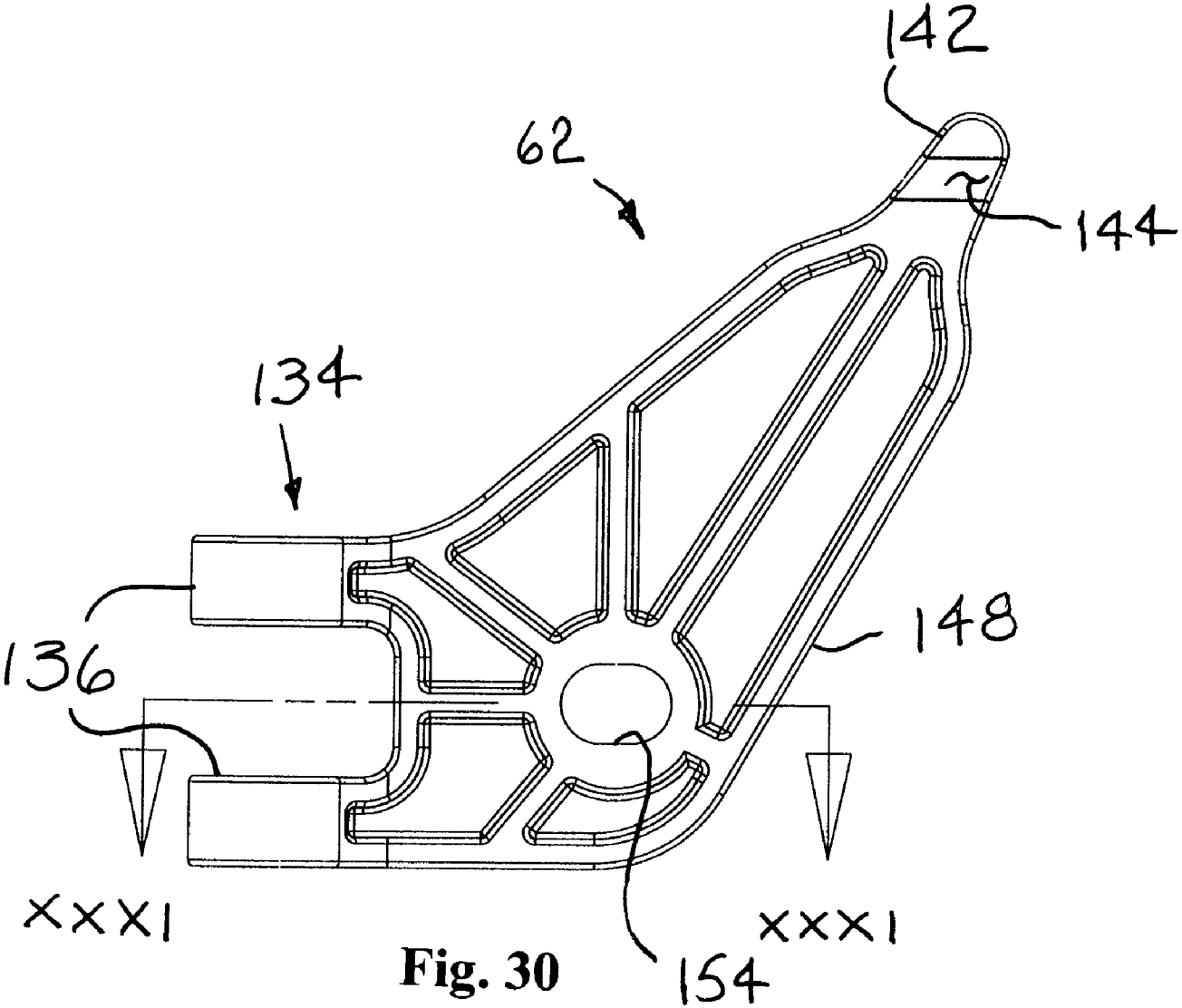
FIG. 30 is a second side elevation view of the lever of FIG. 27.
Figure 31:
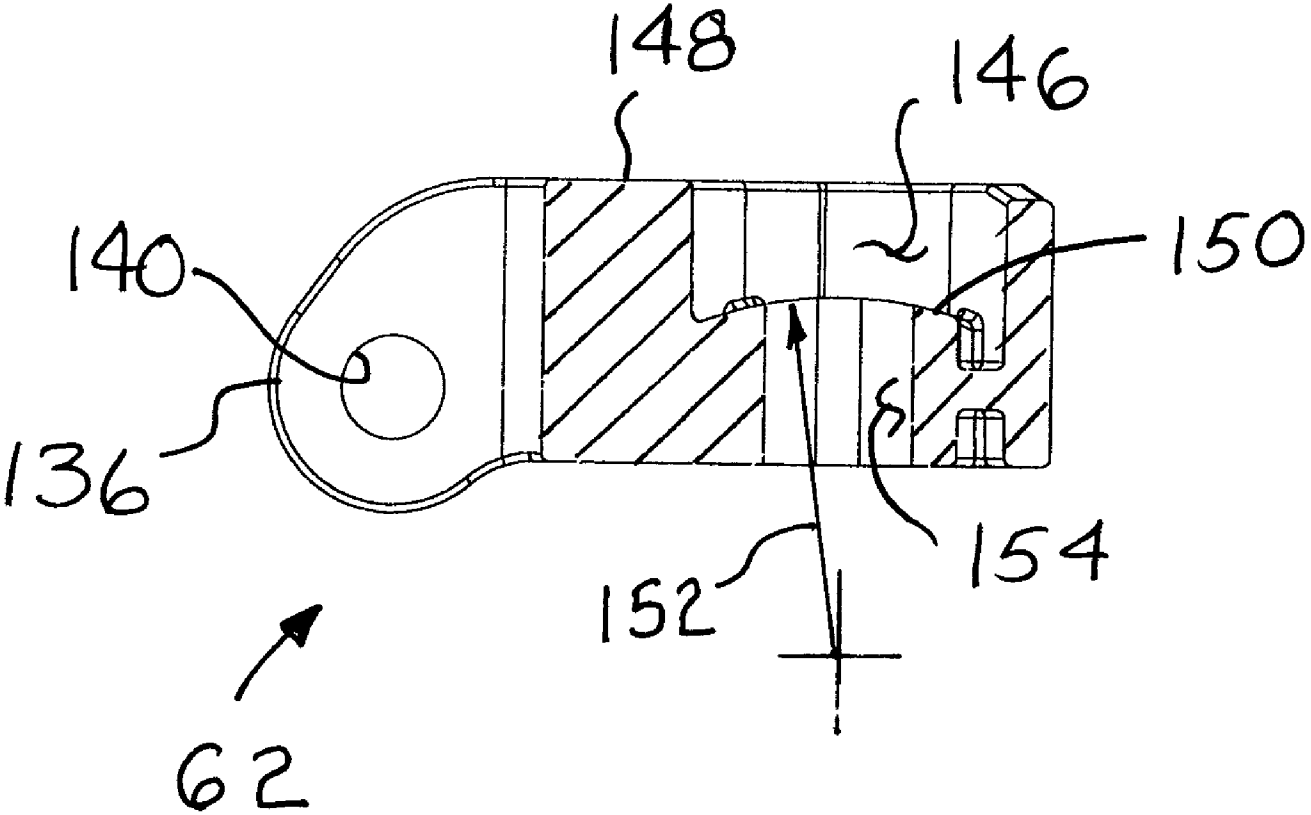
FIG. 31 is a section view taken along line XXXI-XXXI of FIG. 30.
Figure 34:
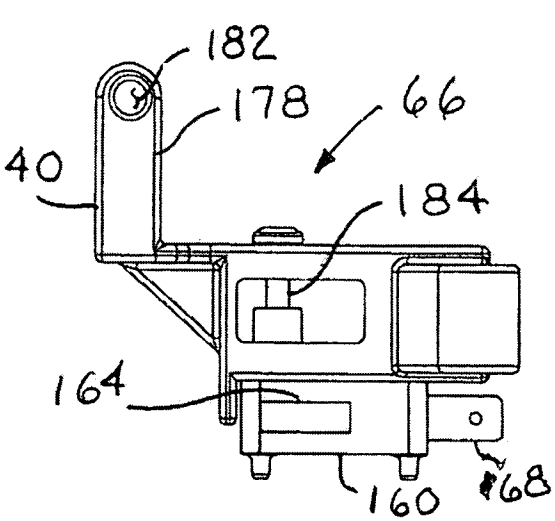
FIG. 34 is a second side elevation view of the pressure switch assembly of FIG. 32.
Figure 33:
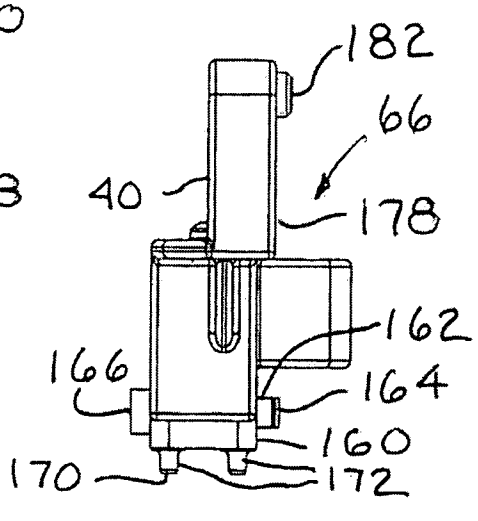
FIG. 33 is an end elevation view of the pressure switch assembly of FIG. 32.
Figure 32:
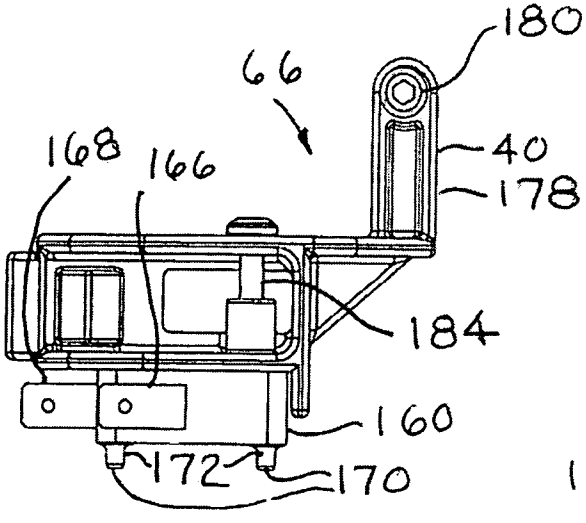
FIG. 32 is a first side elevation view of a pressure switch assembly useful in the practice of the present invention.
Figure 35:
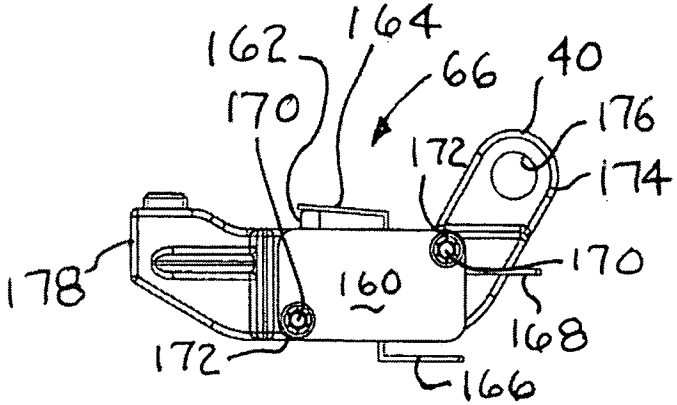
FIG. 35 is a bottom plan view of the pressure switch assembly of FIG. 32.

Referring now most particularly to FIGS. 25 and 26, a side and section view of the pressure transducer assembly 64 may be seen. Assembly 64 includes an outer housing 112 having external threads 114 to secure the assembly in the pump housing. One or more hexagonal bosses 116 are provided with conventional wrench flats 118 to enable installation and removal of the assembly 64. A piston 120 is received in housing 112 and sealed thereagainst by an O-ring 122. Piston 120 has a flange 124 against which a compression spring 126 reacts with respect to the housing 112. A face O-ring 128 seals the outer housing 112 against the pump housing to which it is attached. It is to be understood that an inner face 130 of piston 120 is exposed to the pressure of the paint at the outlet 4 of the pump 8 when the assembly 64 is installed in the pump housing and the pump is operating. In operation, a stem 132 extends out of housing 112 by a distance proportional to the pressure on face 130. Stem 132 will act on the pressure switch assembly 66 in a manner described infra.

Figure 6:
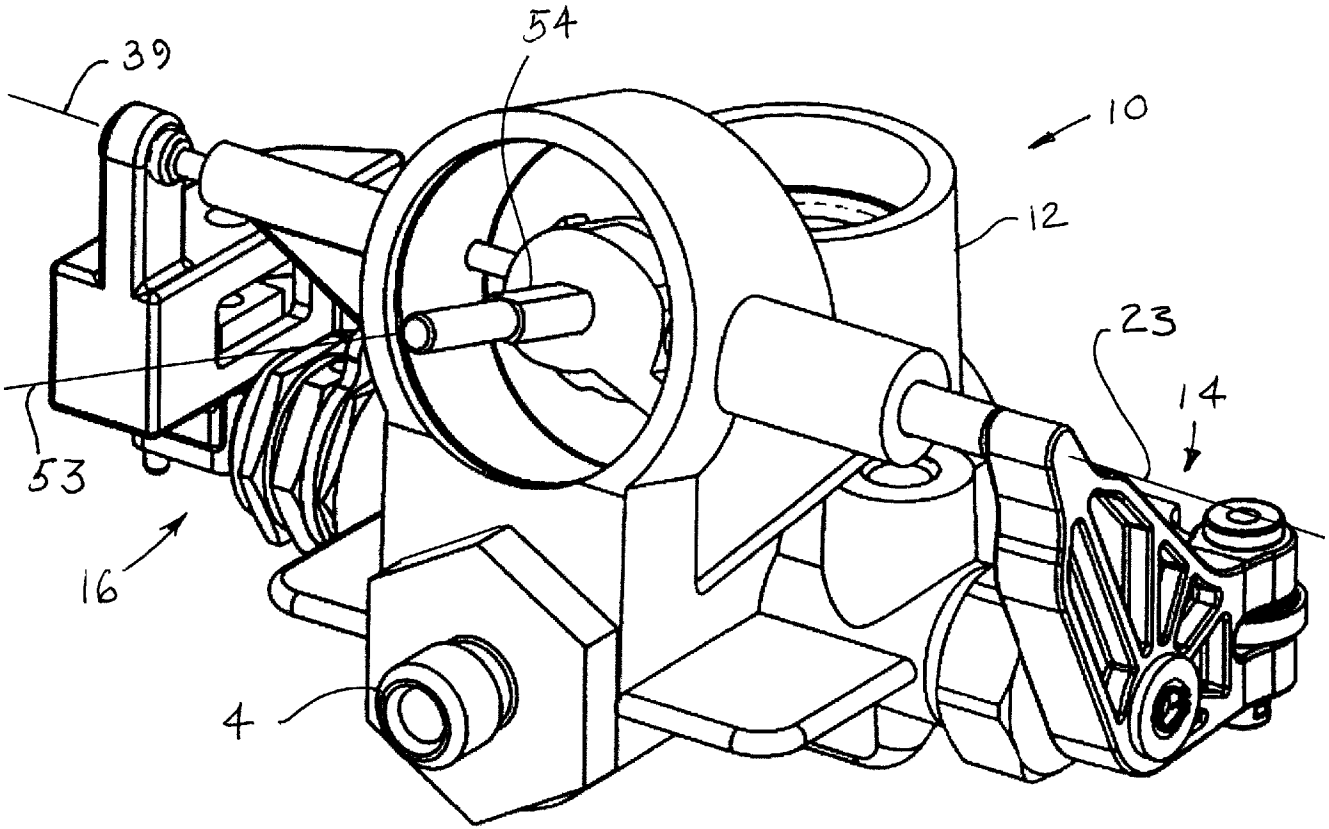
FIG. 6 is a perspective view of the apparatus of the present invention shown from above and to the right.

Turning now to FIGS. 27-31, various views of lever 62 may be seen. Lever 61 is pivotably attached to one of the control housing 12 (as shown in FIG. 6) or to the base housing 13 or the pump housing (as shown by FIG. 11). Lever 62 has a clevis 134 formed by a pair of ring like projections 136, spaced apart from each other and each of which have an aperture 140 to receive the pivot or clevis pin 68 to pivotably secure the lever 62 to a similar apertured ring 138 (see FIG. 11) on the part to which the lever is attached. Lever 62 also has a distal projection 142 to receive the force of the prime control pin 22. A groove 144 may be formed in projection 142 to matingly receive a correspondingly rounded end on pin 22. A recess 146 is formed in the body 148 of the lever 62. An arcuate bearing surface 150 having a radius 152 is formed in the body 148 adjacent the recess 146. Surface 150 preferably has an elongated slot 154 formed therein to receive the valve actuator stem 76. When the parts are assembled, surface 150 is in contact with washer 82.

Figure 7:
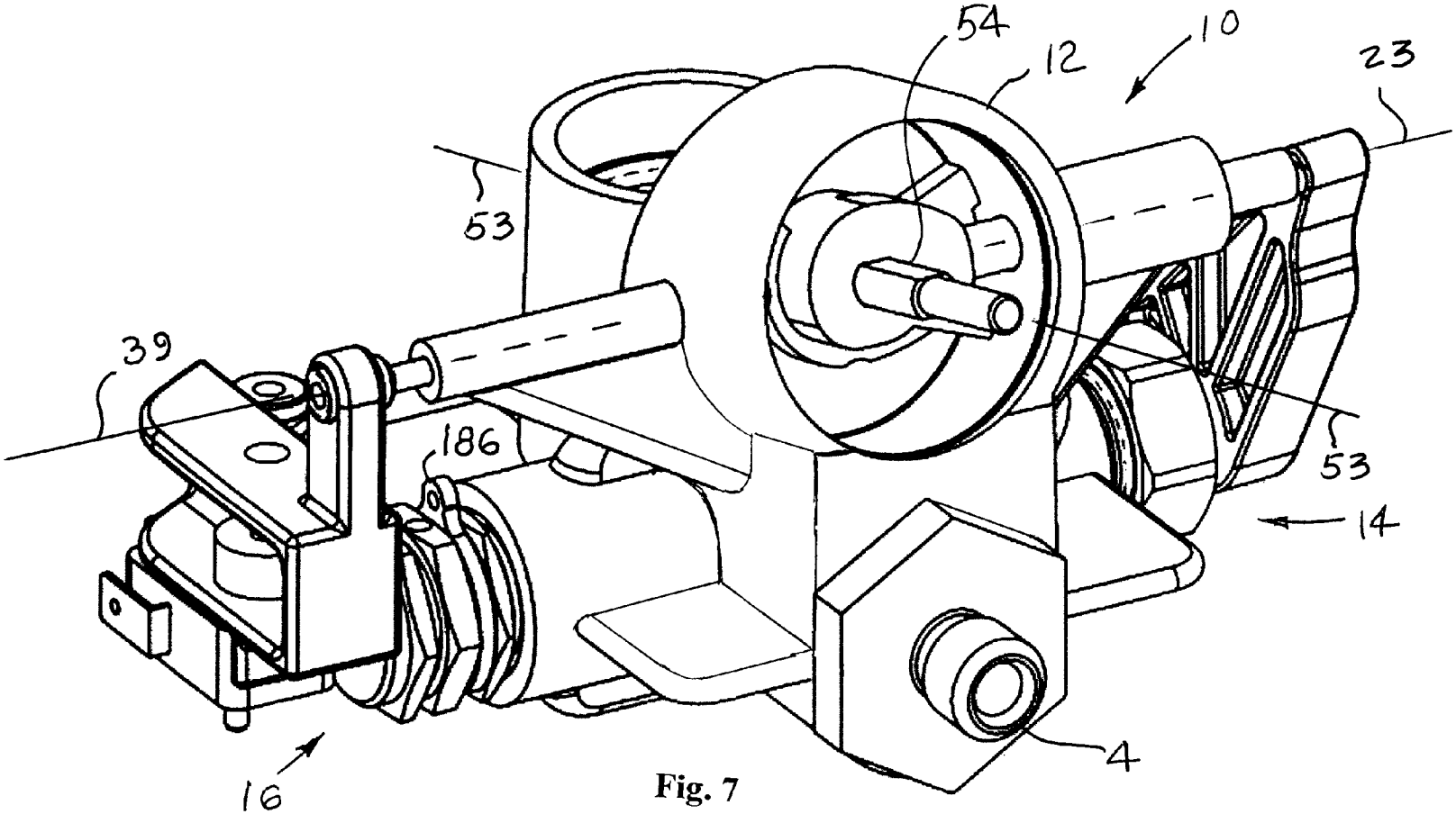
FIG. 7 is a perspective view of the apparatus of the present invention shown from above and to the left.

Referring now most particularly to FIGS. 32-35, various views of the pressure switch assembly 66 may be seen. Assembly 66 includes a conventional switch 160 of the type manufactured under the trademark Microswitch by Honeywell. Switch 160 has an operator 162 covered by a lever 164, and terminals 166, 168 for electrical connection. Switch 160 may be mounted to the switch carrier 40 by a pair of posts 170 with push-on retaining fasteners 172. Carrier 40 may have a first extension 174 with a bore 176 for pivotably mounting the assembly 66 to the base housing 13 using pivot pin 70 (shown in FIG. 11). Carrier 40 may also have a second extension 178 with a set screw 180 installed therein to serve as a bearing surface for pressure control pin 38. As may be seen by reference to FIGS. 7 and 11, the spring 88, connected between a screw 184 in switch carrier 40 and a boss 186 on the pressure transducer assembly 64 preferably urges assembly 66 towards the pressure transducer assembly 64 mounted to base housing 13, while the pressure control pin 38 positions the assembly 66 at a desired distance (corresponding to the desired pressure) from the pressure transducer assembly 64.

Figure 36:
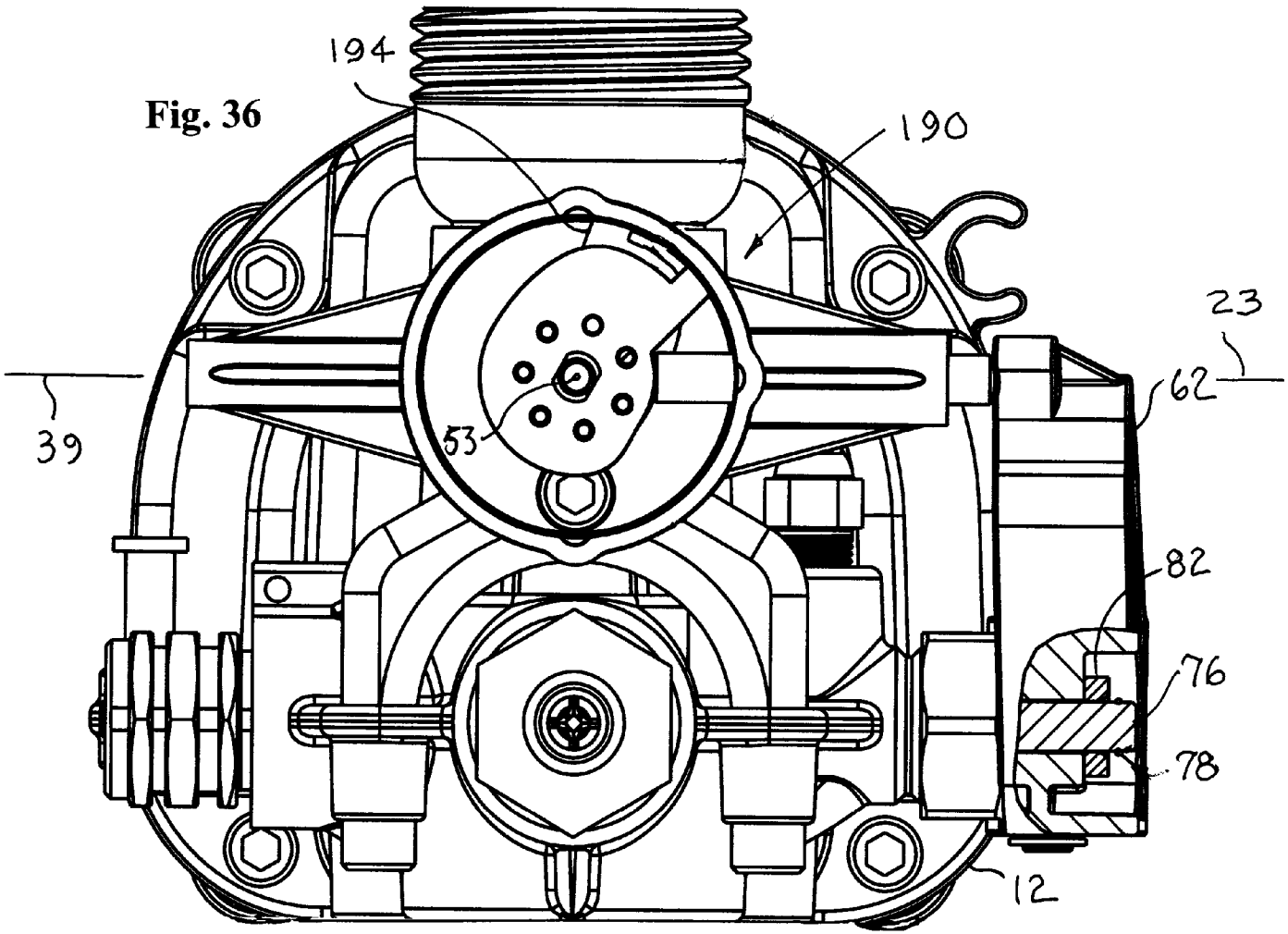
FIG. 36 is a view similar to that of FIG. 10, except with parts shown in a first position during assembly, and with a portion of the lever cutaway to illustrate certain details of the present invention.
Figure 37:
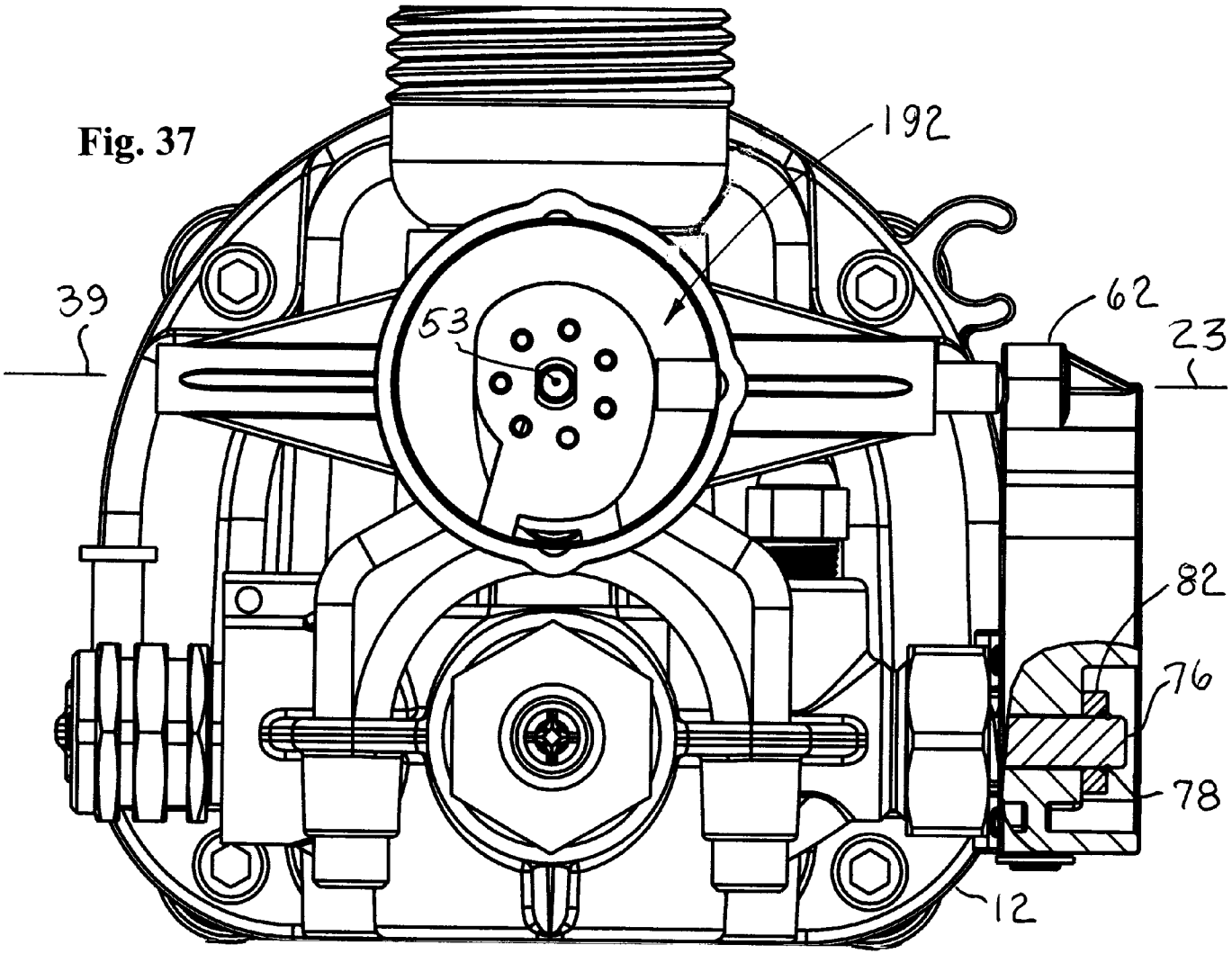
FIG. 37 is a view similar to that of FIG. 36, except with parts shown in a second position during assembly.
Figure 38:
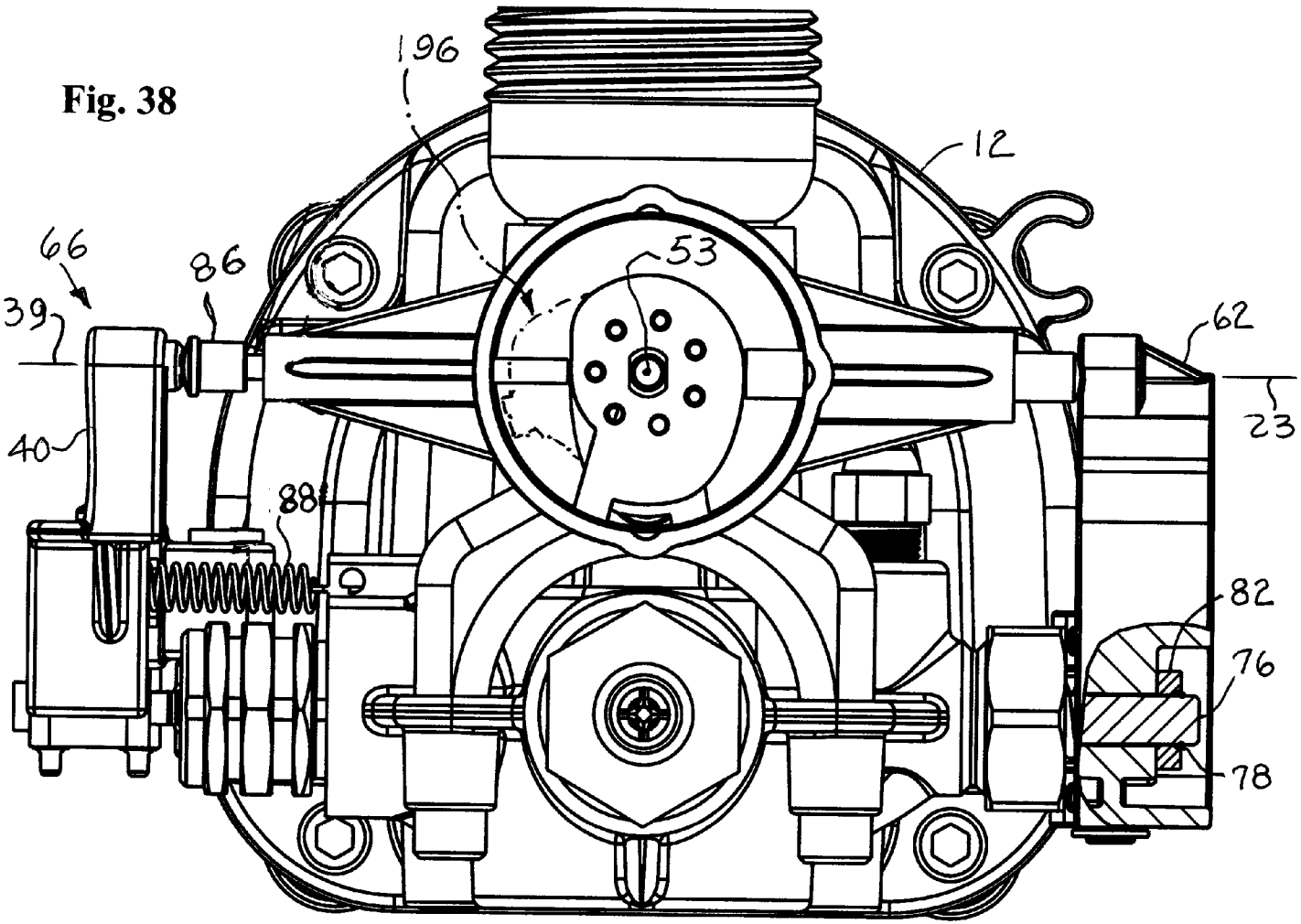
FIG. 38 is a view similar to that of FIG. 37, except with parts shown in a third position during assembly.
Figure 39:
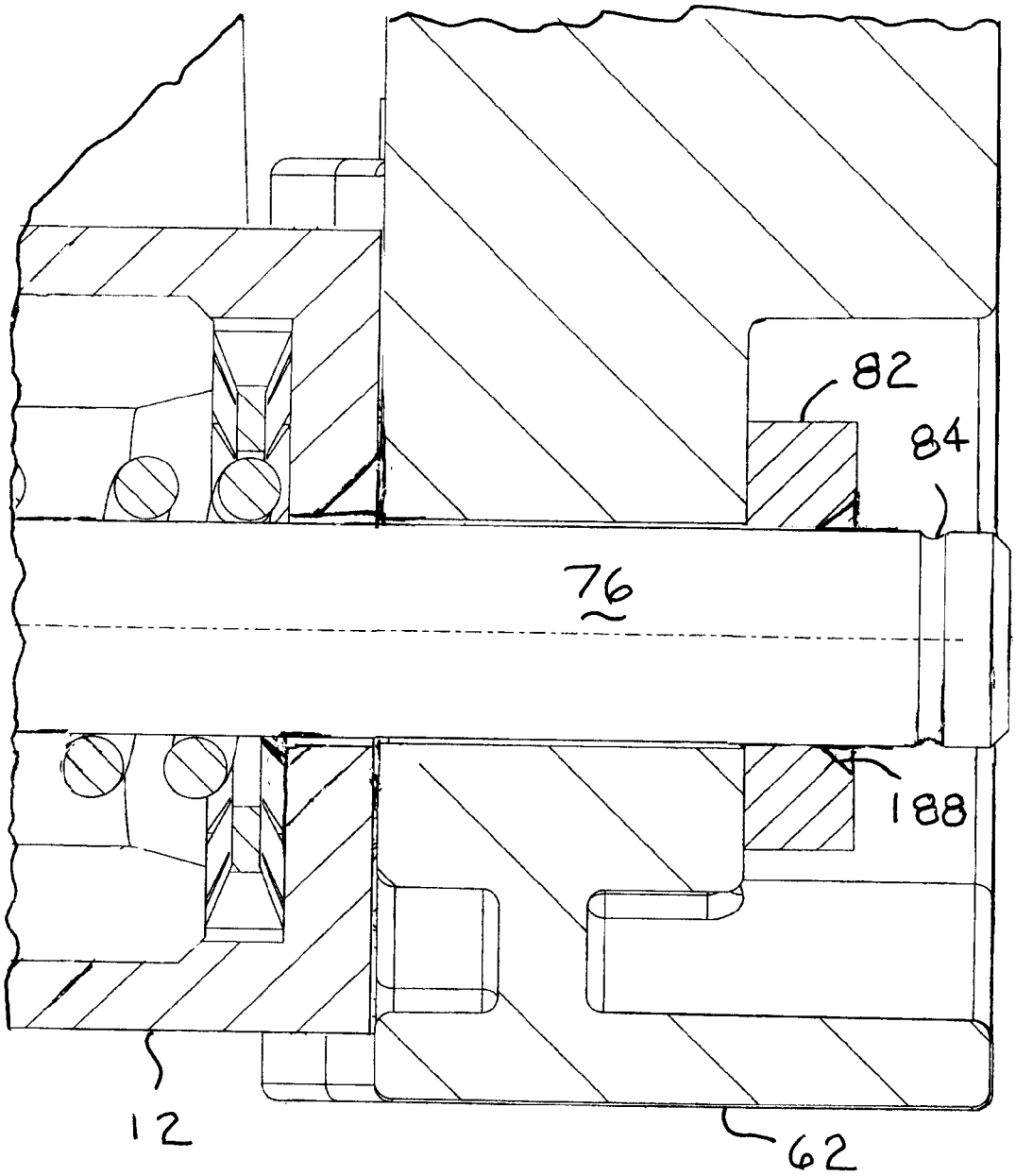
FIG. 39 is an enlarged view of detail XXXIX of FIG. 36 except further cut away and with a C-ring omitted and showing parts in an initial position during an installation process for attachment of the lever to the prime valve in the practice present invention.
Figure 40:
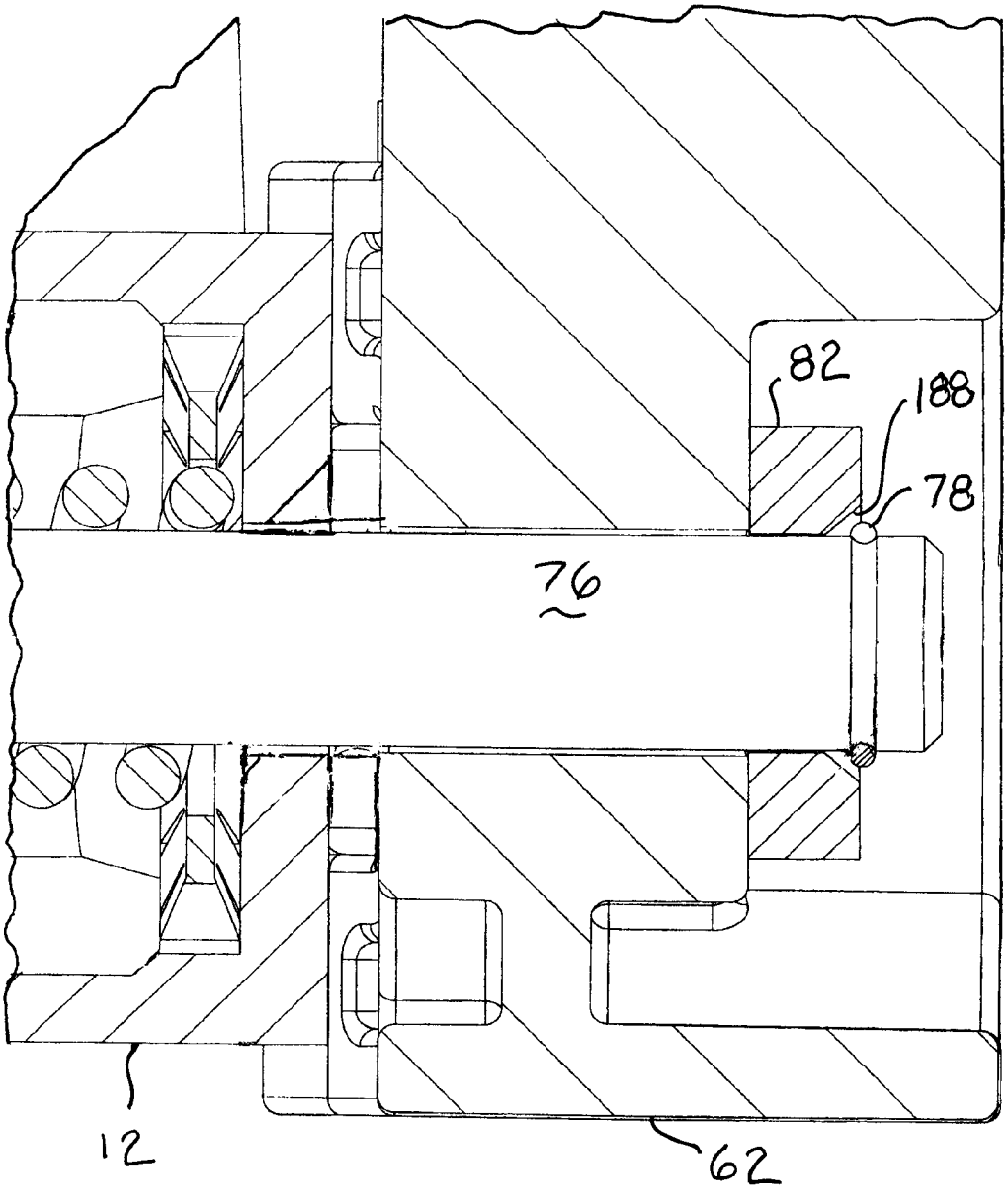
FIG. 40 is an enlarged detail view of detail XIL of FIG. 37 except further cut away and showing parts advanced to a second position from that shown in FIG. 39.

Referring now to FIGS. 36-40 certain aspects of a process of assembly of the prime valve and pressure control apparatus of the present invention may be seen. In FIGS. 36 and 39, parts are shown in a first position during assembly, with a portion of the lever 24 cutaway. To assemble the prime valve parts, the cam assembly 90 is rotated to an "install" position 190 shown in FIG. 36, and the washer 82 is assembled on the valve actuator shaft 76, as may be seen most clearly in FIG. 39, after which the C ring 78 is placed in groove 84 on the shaft 76, retaining the washer 82 and lever 24 to the valve actuator 76. Next, the cam assembly 90 is rotated about 240 degrees counterclockwise to a position 192 shown in FIG. 37, moving the lever 24 away from base housing 13 and causing the ring 78 to become tight against a wedge-shaped recess 188 in washer 82, as may be seen most clearly in FIG. 40.

After the assembly process associated with the prime valve is complete (as described above), the pressure control apparatus may be assembled. The pressure control pin 38 is inserted in bore 110 in the housing 12 (or 12'), cap 86 is placed on pin 38, and the pressure switch assembly 66 is pivotably attached to the base housing 13 using pivot pin 70. Spring 88 is then installed between the pressure switch assembly 66 and the base housing 13, to urge the switch carrier 40 and switch 160 towards and against the stem 162 of the pressure transducer assembly 64. It may be noted that once pin 38 is installed, the cam assembly 90 cannot thereafter be rotated from position 192 back to the install position 190, because of interference between pin 38 and an end-of-travel tab 194 on the second cam 26. Setscrew 180 maybe adjusted in switch carrier 40 by advancing or retracting setscrew 180 in a threading motion with respect to the carrier 40 to calibrate the set point of switch 160 as activated by stem 162 at a desired maximum pressure setting. The maximum pressure setting position 196 is obtained by rotating the cam assembly 90 to the maximum pressure setting position 196 of cam 26. The pump 8 is turned on, and the pressure monitored while the setscrew 180 is screwed into or out of the carrier 40 until the desired pressure setting is reached and the pump is turned off by switch 160 at that pressure.

The invention claimed is:

1. A paint sprayer comprising:

a control housing;

a prime valve disposed within the control housing;

an electrical pressure control including a pressure switch assembly having an electrical pressure switch, the electrical pressure control disposed within the control housing;

a single pin prime valve actuator configured to actuate the prime valve, the single pin prime valve actuator disposed within the control housing;

an electrical pressure control actuator configured to actuate the electrical pressure switch, the electrical pressure control actuator disposed within the control housing;

a single shaft having an axis oriented at substantially a right angle to the single pin prime valve actuator;

wherein the single pin prime valve actuator and the electrical pressure control actuator are each coupled to the single shaft such that movement of the single shaft selectively actuates the paint sprayer to one of a prime mode and a spray mode, and further wherein the electrical pressure control actuator is operable within a range of pressure settings by movement of the single shaft while the paint sprayer remains in the spray mode.

2. The paint sprayer of claim 1 wherein the single pin prime valve actuator is completely cylindrical and has a prime valve actuator axis.

3. The paint sprayer of claim 2 wherein the electrical pressure control actuator comprises a cylindrical pin and is oriented generally parallel with the prime valve actuator axis.

4. The paint sprayer of claim 3 wherein the single pin prime valve actuator and electrical pressure control actuator are oriented generally diametrically opposite one another on opposing sides of the single shaft and are offset along the axis of the single shaft.

5. The paint sprayer of claim 4 further comprising a cam assembly mounted on the single shaft and having a first cam in contact with the single pin prime valve actuator and a second cam in contact with the electrical pressure control actuator.

6. The paint sprayer of claim 5 wherein the first and second cams are offset along the axis of the single shaft.

7. The paint sprayer of claim 4 wherein the prime valve comprises a valve stem with a groove therein, a washer having a wedge-shaped recess, and a C-ring received in the groove, and retained therein by the wedge-shaped recess in the washer, with the valve stem operable by a lever in contact with the single pin prime valve actuator.

8. The paint sprayer of claim 4 further comprising a pressure transducer having a stem, the electrical pressure switch facing the pressure transducer stem, the pressure switch assembly being positionable by the electrical pressure control actuator.

9. The paint sprayer of claim 8 wherein the pressure switch assembly further includes a switch carrier having a setscrew in contact with the electrical pressure control actuator.

10. The paint sprayer of claim 9 wherein the setscrew is adjustable with respect to the switch carrier.

11. In a paint spray pump of the type having an inlet port and an outlet port and a return port and further having a priming mode and a spraying mode, the paint spray pump including a prime valve and a pressure switch assembly having an electrical pressure switch, wherein the prime valve in the priming mode fluidly couples the inlet port to the return port and wherein the prime valve in the spraying mode couples the inlet port to the outlet port, the improvement in combination therewith comprising:

a combined prime valve and electrical pressure control apparatus including:

a prime valve actuator configured to actuate the prime valve; and an electrical pressure control actuator oriented along an electrical pressure control actuator axis and configured to actuate the electrical pressure switch; and a control housing wherein the prime valve actuator and the electrical pressure control actuator are each contained within the control housing and each is coupled to a single shaft oriented generally perpendicularly to the electrical pressure control actuator axis for selectively actuating the electrical pressure control apparatus to one of a prime mode and a spray mode, and further wherein the electrical pressure control apparatus is operable within a range of pressure settings by movement of the shaft while the electrical pressure control apparatus remains in the spray mode.

12. The improvement of claim 11 further comprising a cam assembly mounted on the single shaft for rotation about a single axis and having:

i. a first cam in contact with the prime valve actuator for selectively placing the paint spray pump in the priming mode at a predetermined angular orientation with respect to the axis, and ii. a second cam in contact with the electrical pressure control actuator for selectively placing the paint spray pump in the spraying mode within a predetermined angular range corresponding to the range of pressure settings.

13. The improvement of claim 12 wherein the first and second cams are offset along the single axis.

14. A combined apparatus of prime valve and electrical pressure control for paint spray pumps comprising:

a control housing;

a single pin prime valve actuator contained within the control housing;

an electrical pressure control actuator contained within the control housing;

a single shaft having an axis oriented at substantially a right angle to the single pin prime valve actuator;

a control knob secured to the single shaft; and a cam assembly mounted on the single shaft, the cam assembly including a first cam in contact with the single pin prime valve actuator and a second cam in contact with the electrical pressure control actuator such that rotating the control knob selectively actuates the apparatus to one of a prime mode and a spray mode and the electrical pressure control actuator is operable within a range of pressure settings by movement of the control knob while the apparatus remains in the spray mode.

* * * * *